US007461765B2

(12) United States Patent
French et al.

(10) Patent No.: US 7,461,765 B2
(45) Date of Patent: Dec. 9, 2008

(54) SECURITY HOOD FOR HANDGUN HOLSTERS AND THE LIKE

(75) Inventors: John M. French, Boise, ID (US); Brian J. Shults, Nampa, ID (US)

(73) Assignee: Michaels of Oregon Co., Overland Park, KS (US)

( * ) Notice: Subject to any disclaimer, the term of this patent is extended or adjusted under 35 U.S.C. 154(b) by 432 days.

(21) Appl. No.: 10/916,027

(22) Filed: Aug. 9, 2004

(65) Prior Publication Data

US 2005/0035163 A1 Feb. 17, 2005

Related U.S. Application Data

(60) Provisional application No. 60/493,943, filed on Aug. 7, 2003.

(51) Int. Cl.
*F41C 33/02* (2006.01)

(52) U.S. Cl. ..... 224/243; 224/238; 224/912; 382/126

(58) Field of Classification Search ..... 224/192, 224/193, 196–198, 224–226, 236, 238, 242–244, 224/911, 912; 382/115, 124, 126
See application file for complete search history.

(56) References Cited

U.S. PATENT DOCUMENTS

| | | | | |
|---|---|---|---|---|
| 668,382 | A | 2/1901 | Martin | |
| 1,148,935 | A | 8/1915 | Snavely | |
| 2,483,304 | A * | 9/1949 | Vogel | 220/324 |
| 3,011,687 | A | 12/1961 | Boyt | |
| 3,688,953 | A | 9/1972 | Bianchi | |
| 3,902,639 | A | 9/1975 | Rogers | |
| 3,907,182 | A * | 9/1975 | Bryant | 224/670 |
| RE30,139 | E | 11/1979 | Jones | |
| 4,270,680 | A | 6/1981 | Bianchi | |
| 4,325,505 | A | 4/1982 | Hillman | |

(Continued)

FOREIGN PATENT DOCUMENTS

EP 0174908 A2 * 3/1986

OTHER PUBLICATIONS

Edge Works Manufacturing Co., SOC (special Operations Capable) Rig, http://www.tacticalholsters.com/socrig.htm, 2 pages (Aug. 27, 2002).

(Continued)

*Primary Examiner*—Stephen K Cronin
(74) *Attorney, Agent, or Firm*—Hovey Williams LLP

(57) ABSTRACT

A security hood assembly for a holster includes a hood that is movably supported in association with a holster body so that the hood extends over a portion of a holstered handgun or other service item when the hood in a closed position, to prevent unauthorized removal of the service item. A lever may be operably coupled to the hood for driving the hood toward an open position, to allow the service item to be removed from the holster. In some embodiments, a latch mechanism releasably engages when the hood is in the closed position to prevent the hood from being opened through direct manipulation of the hood. The hood is preferably formed of a substantially rigid material, such as injection molded plastic. Holsters including the security hood assembly may also include internal retention devices, hood biasing mechanisms, and electronic devices responsive to opening of the hood.

49 Claims, 17 Drawing Sheets

U.S. PATENT DOCUMENTS

| | | | | |
|---|---|---|---|---|
| 4,342,410 | A * | 8/1982 | Sloan | 224/243 |
| 4,591,081 | A | 5/1986 | Bianchi et al. | |
| 4,886,197 | A | 12/1989 | Bowles et al. | |
| 5,018,653 | A | 5/1991 | Shoemaker | |
| 5,018,654 | A | 5/1991 | Rogers et al. | |
| 5,094,376 | A | 3/1992 | Baruch | |
| 5,127,566 | A | 7/1992 | Beletsky | |
| 5,199,620 | A | 4/1993 | Beletksy | |
| 5,284,281 | A | 2/1994 | Nichols | |
| 5,419,474 | A | 5/1995 | Marx et al. | |
| 5,501,381 | A | 3/1996 | Rogers et al. | |
| 5,916,087 | A * | 6/1999 | Owens | 5/503.1 |
| 6,161,741 | A | 12/2000 | French | |
| 6,320,975 | B1 * | 11/2001 | Vieweg | 382/124 |
| 6,371,341 | B1 | 4/2002 | Clifton, Jr. | |
| 6,394,211 | B1 * | 5/2002 | Palenchar et al. | 180/69.21 |
| 6,467,660 | B1 | 10/2002 | Rogers et al. | |
| 6,497,352 | B2 * | 12/2002 | Grover | 224/575 |
| 6,547,111 | B2 | 4/2003 | French | |
| 6,616,020 | B1 | 9/2003 | Spielberger | |
| 6,685,067 | B2 | 2/2004 | French | |
| 6,769,581 | B2 | 8/2004 | Rogers et al. | |
| 2002/0153396 | A1 | 10/2002 | French et al. | |
| 2002/0158095 | A1 | 10/2002 | Vor Keller et al. | |
| 2004/0050887 | A1 | 3/2004 | Spielberger | |
| 2006/0011680 | A1 * | 1/2006 | Cook et al. | 224/243 |

OTHER PUBLICATIONS

Edge Works Manufacturing Co., SOC RIG 9 sheets (Aug. 27, 2002).
Visier, Das internationale Waffen-Magazin Apr. 1999, Ausgabe; Apr. 1999, Seiten 51-55, ISSN 0933-4491.

* cited by examiner 20
140
110
150
100
80
154
92
156
88,128
70
144
146
34
30
170
46
48
112
54
76
66
62
10

SECURITY HOOD FOR HANDGUN HOLSTERS AND THE LIKE

RELATED APPLICATIONS

This application claims the benefit under 35 U.S.C. § 119 (e) of U.S. Provisional Patent Application No. 60/493,943, filed Aug. 7, 2003, which is incorporated herein by reference.

TECHNICAL FIELD

This application relates to the field of holsters for service items such as handguns and radios, to security devices for preventing unauthorized removal of a holstered service item, and to a movable security hood for a holster.

BACKGROUND OF THE INVENTION

Handgun holsters having security features such as safety straps and internal handgun restraint devices are well known for preventing inadvertent or unauthorized withdrawal of a handgun. A common security feature is a thumb-break safety strap that includes a flexible strap extending from an outer sidewall of the holster upwardly and over a top opening of the holster toward an inner sidewall of the holster, where it snaps or otherwise releasably connects to a thumb-break arm or tab. One drawback of thumb-break safety straps is that they can be difficult to quickly reattach when re-holstering the handgun, which can be problematic for a law enforcement officer involved in a chase or engaged in a struggle with an adversary.

U.S. Pat. No. 5,501,381 (the "'381 patent") of Rogers et al. describes a handgun holster having a pivoting safety strap that rotates between a locked position where the strap bridges across a top opening of the holster and an open position forward of the top opening. A spring-actuated detent mechanism prevents the strap from being opened until selectively released by pressing downwardly on a portion of the strap, after which the strap can be manually pivoted forwardly to allow withdrawal of the handgun. When re-holstering the handgun, the strap is closed by manually pivoting it back to the upright closed position, where the detent mechanism engages under spring force to lock the safety strap.

In an effort to improve the security of the pivoting safety strap of the '381 patent, U.S. Pat. No. 6,371,341 (the "'341 patent") describes a releasable blocking mechanism that interferes with downward motion of the safety strap to prevent disengagement of the detent mechanism. To open the safety strap, the user first pivots the blocking member away from the safety strap using his or her thumb, then moves his or her thumb to the safety strap, presses the strap downwardly to disengage the detent mechanism, and rotates the strap forwardly.

The present inventors have recognized that when moving the pivoting safety straps of the '381 and '341 patents forwardly with the thumb, it is difficult or impossible for most users to simultaneously grasp the grip of the handgun. The blocking mechanism of the '341 patent may also interfere with a user's ability to quickly draw his or her weapon when necessary. For improved security and speed of handling, the inventors have recognized a need for a pivoting security hood that can be opened while simultaneously holding the handgun grip or resting the palm of the hand on the butt of the handgun grip. The present inventors have also recognized a need for a pivoting security hood that locks when in the closed position to prevent the hood from being opened through manipulation of the hood, thereby preventing unauthorized access to a holstered handgun or other item.

SUMMARY

A security hood assembly for a holster includes a hood that is movably supported in association with a holster body so that the hood extends over a portion of a holstered handgun or other service item when the hood in a closed position, to prevent unauthorized removal of the service item. In a preferred embodiment, a lever of the security hood assembly is operably associated with the hood. The security hood assembly may include means for driving the hood toward an open position in response to operation of the lever, to allow the service item to be removed from the holster. In some embodiments, the lever is operably coupled to the hood such that the hood is driven forwardly toward the open position when the lever is moved rearwardly with the user's thumb, during which operation the palm of the user's hand may rest against or grasp a part of the holstered service item, such as the grip of a holstered handgun. The hood may be supported by the holster body or a common mounting platform for rotation about a hood pivot axis, and the lever may be supported on the holster body or some other part of the holster for rotation about a lever pivot axis, preferably parallel to the hood pivot axis. Exemplary linkages for operably coupling the lever to the hood include cam mechanisms and gear systems, for example.

In one embodiment, a holster with the security hood assembly includes a latch mechanism that releasably engages when the hood is in the closed position to prevent the hood from being opened through direct manipulation of the hood. The latch mechanism may be disengaged by moving or flexing at least a portion of the lever in a first direction relative to the hood, and thereafter moving the lever in a second direction different from the first direction to drive the hood toward the open position. Holsters including the security hood assembly may include internal retention devices within the holster body for added levels of security. A biasing mechanism, such as a spring, may also be provided for biasing the hood relative to the body, to urge the hood toward the open position or, in some embodiments, toward the closed position.

In some embodiments, the hood is made substantially rigid, for example by molding the security hood of a plastic resin. The hood may include a spanning portion that spans across an opening of the holster body and a skirt portion that depends from the spanning portion to overlap with the holster body and protect a holstered item from debris and damage. To prevent accidental discharge of a holstered cocked handgun, the security hood may also be configured to physically interrupt travel of the handgun's hammer when the hood is in the closed position.

Additional aspects and advantages of the invention will be apparent from the following detailed description of preferred embodiments, which proceeds with reference to the accompanying drawings.

BRIEF DESCRIPTION OF THE DRAWINGS

In the drawing figures, like reference numbers refer to like elements.

DETAILED DESCRIPTION OF PREFERRED EMBODIMENTS

Throughout the specification, reference to "one embodiment," "an embodiment," or "some embodiments" means that a particular described feature, structure, or characteristic is included in at least one embodiment. Thus appearances of the phrases "in one embodiment," "in an embodiment," or "in some embodiments" in various places throughout this specification do not necessarily refer to the same embodiment.

Furthermore, the described features, structures, and characteristics may be combined in any suitable manner in one or more embodiments. Those skilled in the art will recognize that the invention can be practiced without one or more of the specific details, or with other methods, components, materials, etc. In some instances, well-known structures, materials, and operations are omitted or not described in detail to avoid obscuring aspects of the embodiments.

Figure 1:
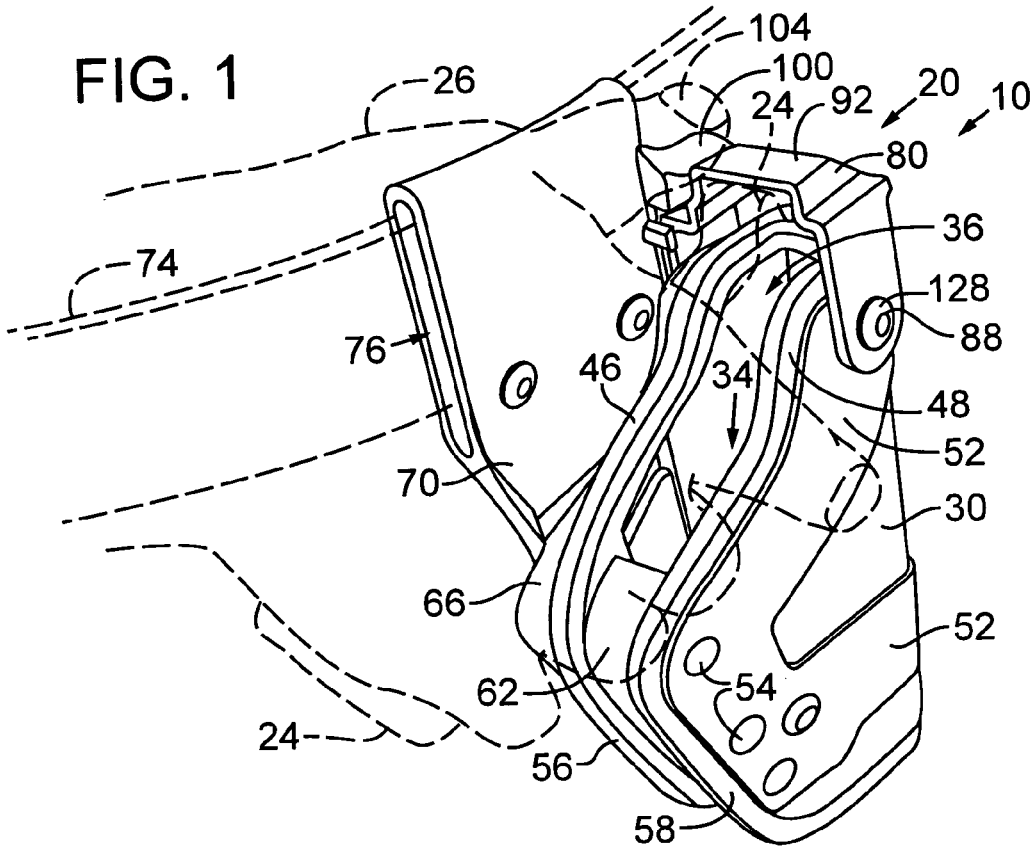
FIG. 1 is a perspective view of a handgun holster in accordance with a first embodiment with a pivoting security hood assembly of the holster shown in its closed and latched position.
Figure 3:
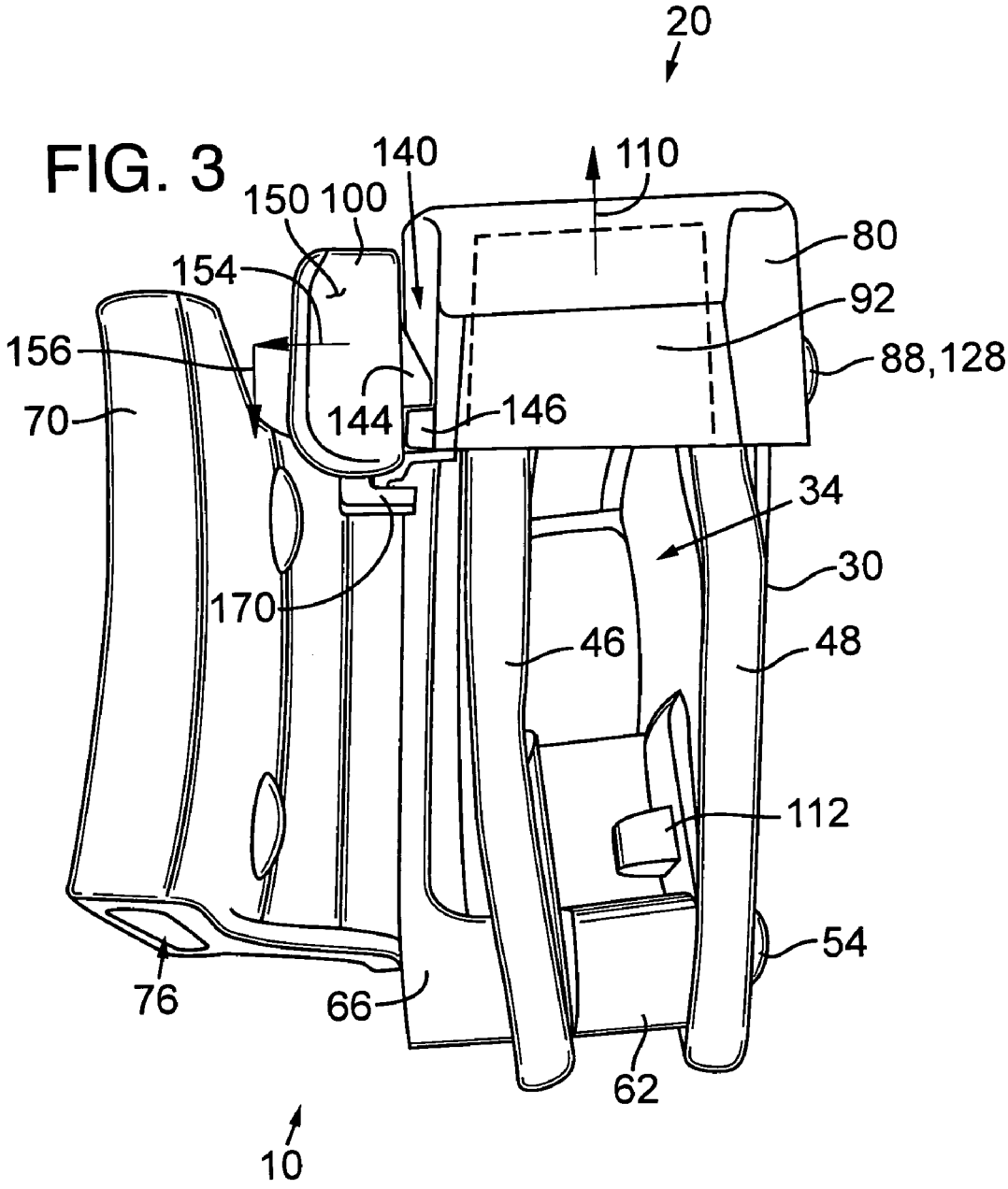
FIG. 3 is top pictorial view of the holster of FIG. 1, with arrows illustrating two different directions in which the lever of the security hood assembly is moved for first unlocking a latch mechanism of the assembly and thereafter driving the hood toward the open position.
Figure 4:
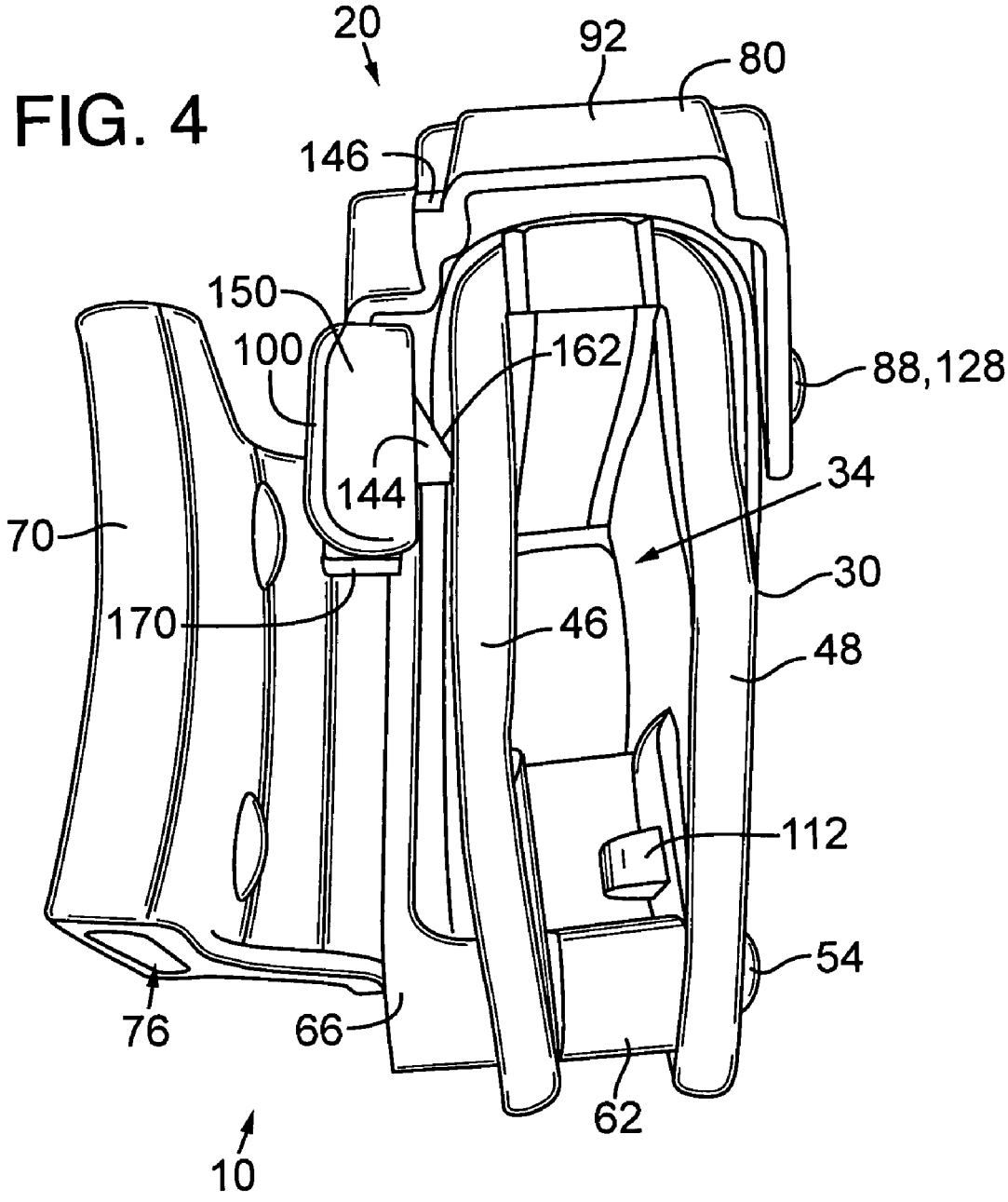
FIG. 4 is a top pictorial view of the holster of FIG. 2, with the user's hand omitted for clarity.

FIG. 1 is a perspective view of a holster 10 including a security hood assembly 20 in accordance with a first embodiment. With reference to FIG. 1, a handgun 24 and a user's hand 26 are shown in phantom with dashed lines to avoid obscuring details of holster 10. Holster 10 includes a body 30 that defines a cavity 34 and a top opening 36 sized to admit at least a portion of handgun 24 into cavity 34. Cavity 34 may also be open in other places, such as along its bottom end (as shown in FIGS. 3, 4, and 6), but may preferably be closed to inhibit debris from entering cavity 34. Body 30 may be made of a wide variety of materials, such as leather, fabric, molded plastic, and other natural and synthetic materials, for example, and by any of a variety of manufacturing methods, such as molding, sewing, lamination, riveting, and other methods. An exemplary laminate holster body is shown in FIGS. 1-7 and described in more detail in U.S. Pat. No. 5,419,474 of Marx et al., the relevant disclosure of which is incorporated herein by reference. Other embodiments of the holster body are described below with reference to FIGS. 8-28.

With reference to FIG. 1, body 30 may include a multilayer laminate sheet 42 bent in a generally horizontal U-shaped configuration to form opposing inner and outer sidewalls 46 and 48, respectively. Body 30 also may include a plastic frame 52, which serves as an exoskeleton that reinforces and adds rigidity to body 30. Sidewalls 46 and 48 are secured together with rivets or other fasteners 54 at respective inner and outer rear margins 56 and 58 along a welt or, more preferably, with a spacer block 62 secured between rear margins 56 and 58.

As mentioned above, body 30 is preferably sized to fit a handgun. However, in some embodiments, body 30 and security hood assembly 20 may also be sized and shaped to accommodate and fit one or more other types of side arms and service items, such as stun guns (for example, the kind under the trademark TASER®), knives, batons (truncheons), ammunition magazines, dispensing devices for chemical agents such as pepper spray, non-weapon service items, such as radios and handcuffs, and any other items carried by military or law enforcement personnel. Thus while the preferred embodiments described herein are adapted to secure handguns, the security hood assemblies and holsters consistent with the embodiments described herein may easily be modified or configured for use with a variety of service items other than handguns.

Holster 10 may include a backing plate 66 mounted to body 30 adjacent inner side wall 46. Backing plate 66 provides a rigid mounting platform for attaching a belt loop 70 to body 30. Backing plate 66 may also provide a rigid common platform for supporting security hood assembly 20 in association with body 30. Backing plate 66 is preferably made of a rigid plastic material such as ABS, for example. In FIG. 1, a duty belt 74 is shown in dashed lines extending through a throat opening 76 of belt loop 70. Belt loop 70 may comprise any of a variety of known belt loop structures, including, for example, the detachable belt loop shown in U.S. Pat. No. 6,161,741 of French, incorporated herein by reference. For clarity, holster 10 is shown and described as a right-handed holster, in which security hood assembly 20 is operable with the thumb 104 of a user's right hand 26, as described below with reference to FIG. 2. However, an alternative left-handed embodiment (not shown) is a mirror image of the right-handed holster 10 of FIG. 1 and is adapted to be mounted on a user's left side for left-handed weapon handling.

Referring again to FIG. 1, security hood assembly 20 includes a hood 80 rotatably mounted on body 30 via at least one pivot joint 88. Hood 80 is shown in FIG. 1 in a closed position wherein hood 80 extends over at least a portion of handgun 24 and, incidentally, over at least a portion of top opening 36 of cavity 34. Cavity 34 is preferably shaped and configured to follow the contours of handgun 24 to define a constrained draw path 118 (FIG. 2) requiring handgun 24 to be drawn vertically from holster 10, rather than in some other direction such as rearward. By requiring handgun 24 to be drawn in a particular direction, the shape of cavity 34 cooperates with hood 80 when hood 80 is in the closed position to prevent handgun 24 from being removed from holster 10. The particular direction of drawing handgun 24, however is arbitrary. For example, holster 10 may be rotated to a horizontal orientation so that top opening 36 becomes a side opening and handgun 24 is drawn along a generally horizontal draw path. Thus, the movable security hood disclosed herein may be combined with other holster body configurations and constrained draw paths to cover or block at least a portion of the draw path for retaining a service item in holster 10.

Figure 2:
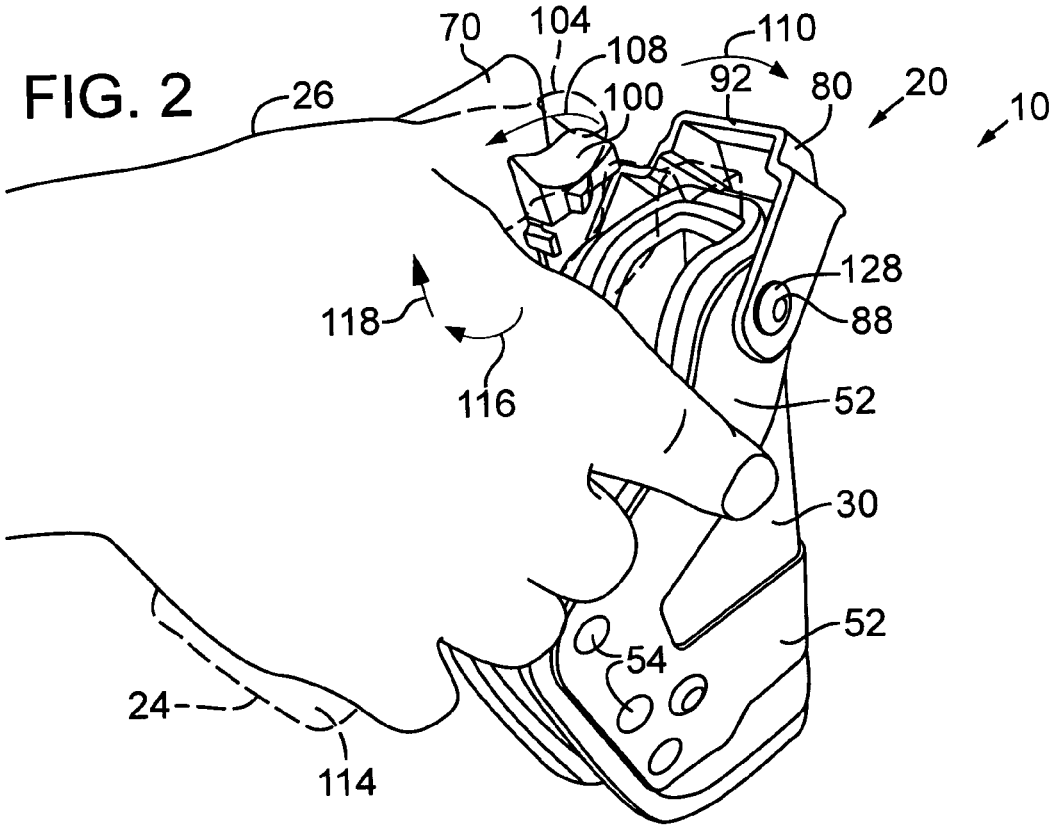
FIG. 2 is a rear perspective view of the holster of FIG. 1 with a hood of the assembly being driven forwardly toward an open position by manual movement of a lever of the assembly, to allow handgun holstering and removal.

With reference to FIGS. 1 and 2, security hood assembly 20 further includes a lever 100 operably coupled to hood 80 and positioned for manual manipulation via the user's thumb 104 for driving hood 80 toward an open position, as shown in FIG. 2. With reference to FIG. 2, movement of lever 100 rearwardly in the direction shown by arrow 108 causes hood 80 to rotate forward relative to body 30 in the direction shown by arrow 110. In alternative embodiments (not shown), lever 100 is coupled or geared to hood 80 such that hood 80 is rotated forward in response to movement of lever 100 or in another direction, such as downward, forward, inward, or outward. In yet other embodiments, lever 100 is configured and mounted to actuate hood 80 by direct downward or rearward motion, and may include a component slidably mounted on body 30. In still other embodiments, lever 100 may itself be driven by another device, such as a separately movable lever or slider, by a motor-drive mechanism, or a mechanism that also releases an internal retention device, thus eliminating the need for direct manipulation of lever to open hood 80. After hood 80 has been rotated to the open position, handgun 24 can be drawn from holster 10. Lever 100 is preferably molded of a 10% glass filled nylon 6 material for its strength and resiliency, but other materials may also be suitable.

Holster 10 preferably includes an internal retention device 112 (FIGS. 3 and 6) such as the type described in U.S. Pat. No. 6,547,111, incorporated herein by reference. In accordance with the embodiment shown, internal retention device 112 requires the user to twist a grip portion 114 of handgun 24 inwardly in the direction shown by arrow 116 before drawing handgun 24 upwardly in the direction shown by arrow 118. FIG. 6 depicts how a trigger guard 122 of handgun 24 is engaged by a wedge-shaped catch 124 of internal retention device 112 when handgun 24 is holstered. The sequential layers or levels of security provided by combining internal retention device 112 with security hood assembly 20 further prevent inadvertent or unauthorized removal of handgun 24 from holster 10. Although holster 10 in accordance with preferred embodiments includes an internal retention device in accordance with U.S. Pat. No. 6,547,111, the term "internal retention device," as used herein, should be construed broadly to include other types of handgun restraining devices that extend into cavity 34 to engage a portion of handgun 24 when holstered and any other devices supplemental to or independent of security hood assembly 20 for engaging handgun 24 or another service item in holster 10 to releasably retain it in cavity 34, regardless of whether such device itself extends into cavity 34. Thus security hood assembly 20 may be used with any of a variety of internal retention devices and secondary security devices, including mechanically operated devices, such as devices that engage a part of the handgun (for example, the trigger guard or shell ejection port); motor- or solenoid-driven devices; magnetic retention devices such as the type described in U.S. Pat. No. 6,616,020 of Spielberger; safety straps of all kinds; and other devices for engaging and retaining handgun 24 in cavity 34.

Because security hood assembly 20 may be operated by moving lever 100 in a direction other than forwardly, the user's hand 26 can remain in contact with grip 114 of handgun 24 while hood 80 is being opened, providing added security and control over handgun 24. Grip 114 can also be twisted inwardly in the direction shown by arrow 116 simultaneously with manipulation of lever 100, to thereby release handgun 24 from internal retention device 112 simultaneously with opening of security hood 80 for added speed of handling. Simultaneous rearward, downward, or outward movement of the user's thumb 104 and inward twisting of grip 114 is similar to the natural grasping action of the user's hand 26 and fingers when the user is wearing holster 10 in the side-holstered position shown in FIG. 2. However, simultaneous inward twisting of grip 114 and movement of lever 100 would be difficult for a person not wearing holster 10 at his or her side, which may provide the user with added security against unauthorized access by an assailant.

Hood 80 is preferably made of a rigid material such as cast, molded, and/or machined plastic, metal, ceramics, and composites, for example, but may also comprise other structures, such as a flexible, rigid, or semi-rigid strap that extends between pivot joints 88 on inner and outer sidewalls 46 and 48 and spans over a holstered handgun or other service item, for example. Hood 80 preferably includes at least a spanning portion 92 (see also FIGS. 9, 12, 19, and 20, described below) to retain handgun 24 when hood 80 is in the closed position. Spanning portion 92 (also referred to as a bail) is preferably formed of a substantially rigid material, such as injection molded plastic resin, for example, but may also be formed of flexible or semi-rigid materials. Among other benefits, a rigid spanning portion 92 is less susceptible than a flexible strap to be being folded, bent, or stretched forward to allow unauthorized withdrawal of a holstered weapon, or folded, bent, or stretched rearward, where it may catch on handgun 24 (e.g., around the grip safety of an M-1911 or under the slide of a GLOCK) and frustrate a user's ability to open hood 80 and draw his or her weapon. A rigid spanning portion 92 may also require less maintenance. Hood 80 may further include a front skirt portion 96 (FIG. 12) that depends downwardly from spanning portion 92 and cooperates with spanning portion 92 and body 30 to cover or otherwise shield a holstered handgun 24 or service item from debris and damage. For example, front skirt portion 96 may be especially useful for motorcycle police, to inhibit road debris and water from being blown or splashed into cavity 34 or the service item while riding. Front skirt portion 96 preferably overlaps a top rim of body 30 when hood 80 is in the closed position and may, in some embodiments, seal closely against an outer portion of the top rim to provide splash-resistant protection for a holstered service item. Hood may further include an optional rear skirt portion (not shown) extending rearward from spanning portion 92 to cover grip 114 (FIG. 5) of a holstered handgun 24 or to otherwise more fully cover top opening 36 of cavity 34 and protect a holstered item from the effects of the environment, debris, and damage, when hood 80 is in the closed position. Front skirt portion 96 and rear skirt portion may be formed of a flexible, rigid, or semi-rigid material and fastened to spanning portion 92 to form a lid or shroud assembly, but are preferably formed of one-piece construction with spanning portion 92 to form a unitary shroud part. Hood 80 and its component parts are preferably molded of a 10% glass filled nylon 6 material, but other materials may also be suitable. While skirt portions (and particularly front skirt portion 96) are generally desirable to provide added protection for a holstered item, the term "hood," as used herein, is intended to include any of the various kinds of spanning members, bails, covers, lids, shrouds, and straps described herein that may extend over at least a portion of a holstered service item and cooperate with holster body 30 to retain the service item in cavity 34, and is not intended to be limited to devices with front or rear skirt portions or to devices that rotate about a particular axis relative to body 30.

If made of a rigid material, hood 80 may be rotatably connected to body 30 by a single pivot joint 88, preferably located on either the inner or outer sidewall 46 or 48. However, for durability and reliability, hood 80 is preferably connected to body 30 by a pair of inner and outer pivot pins 126 and 128, respectively, forming two pivot joints, which are described below with reference to FIGS. 6 and 7. In other embodiments, hood 80 may be supported for movement modes other than rotation about a horizontal hood pivot axis 190 (FIG. 6). For example, hood may be slidably mounted to a track formed in or on body 30 and may be movable along a linear or curvilinear path between the open and closed positions. Hood may also be rotatable or pivotable about one or more axes oriented in a different location or orientation than horizontal hood pivot axis 190.

Advantageously, hood 80 may be shaped and configured to cover and protect a sighting device (not shown) on handgun 24, such as a rear sight blade of iron sights. Thus, hood 80 may prevent a sighting device from being damaged or knocked out of alignment due to impacts with foreign objects or structures. Hood 80 may also be shaped and configured to protect a rear portion of handgun 24 and may include features for preventing inadvertent discharge of handgun 24 while holstered. For example, hood 80 may include a blocking member or section that interferes with movement of a hammer and/or firing pin of the handgun. One embodiment of hood 80 includes a blocking member or blocking section that is interposed between the hammer and the firing pin or slide of handgun 24 when hood 80 is in the closed position and the hammer is cocked. This optional feature is especially desirable when the security hood assembly 20 is used with handguns of the type commonly used by law enforcement officers and normally carried "cocked and locked," including government model 45 caliber pistols such as the COLT® 1911 Series pistols sold by Colt's Manufacturing Company, Inc., Hartford, Conn., USA. The blocking member or blocking section of hood 80 interrupts travel of the hammer to prevent accidental discharge of the handgun 24 in the event that the handgun's safety is inadvertently left unlocked or the hammer is somehow accidentally released while handgun 24 is in holster 10.

FIG. 3 is a top pictorial view of holster 10 including security hood assembly 20 shown in the closed position. With reference to FIG. 3, security hood assembly 20 includes a latch mechanism 140 that releasably engages when hood 80 is in the closed position to prevent hood 80 from being inadvertently opened through direct manipulation of hood 80 or otherwise. Latch mechanism 140 may include any of a variety of stops, tabs, detents, and other devices for securing hood 80 relative to body 30 when hood 80 is in the closed position, but preferably includes a first latch part 144 on lever 100 that cooperates with a second latch part 146 on hood 80. First latch part 144 preferably extends outwardly from a thumb pad portion 150 of lever 100, and second latch part 146 preferably extends inwardly from hood 80 toward latch 100. Respective first and second latch parts 144 and 146 are aligned when security hood assembly 20 is in the closed position to engage each other and oppose rearward movement of lever 100 and forward movement of hood 80. To disengage latch mechanism 140, the user engages lever 100 via thumb pad portion 150 to move at least a portion of lever 100 in a first direction 154 relative to body 30 followed by movement of lever 100 in a second direction 156 different from first direction 154. In a preferred embodiment, first direction 154 involves flexing lever 100 to move thumb pad portion 150 and first latch part 144 inwardly, and second direction 156 involves rotating lever 100 rearward. However, in other embodiments, movement of a portion of lever 100 in the first direction could include moving a part of lever 100 or latch mechanism 140 in another first direction, such as downward, inward, outward, or forward, before movement of lever 100 in the second direction. Also, the second direction may include movement in a direction other than rearward, such as inward, outward, forward, or downward. In yet other embodiments (not shown), lever 100 may be mounted in other locations on holster 10, such as along outer sidewall 48 of body 30. When mounted along outer sidewall 48, lever 100 actuated by the user's index finger for rotation or sliding movement of lever 100 in an inward, downward, or rearward direction. Regardless of the sequence of movements required to release latch mechanism 140, it should preferably be possible for the user to keep the palm of his or her hand 26 on grip 114 of handgun 24 while releasing latch mechanism 140 and opening hood 80. However, in some embodiments, movement of lever 100 in respective first and second directions may involve lifting the hand 26 from grip 114 when operating latch mechanism 140 and/or security hood assembly 20. For improved gripping, thumb pad portion 150 may include a knurled or textured surface formed or molded into its surface, or may include a high-friction material, such as rubber, that is formed, embedded, or molded into thumb pad portion 150 or otherwise attached thereto.

Operation of latch mechanism 140 may also cause an internal retention device or other secondary security device to be released, locked, opened, closed, put into a stand-by mode, or set to a heightened security mode. For this purpose, latch mechanism 140 may be operably coupled to or form part of an electronic switch that is opened or closed in response to movement of lever 100.

FIG. 4 is another top pictorial view of holster 10, which shows security hood assembly 20 in the open position following release of latch mechanism 140 and rearward movement of lever 100, as described above with reference to FIG. 3. From this open position, internal retention device 112 can be released through manipulation of handgun 24 or, in alternative embodiments, through some other action such as manipulation of a secondary handgun retention device or by fingerprint identification, for example. To return security hood assembly 20 to the closed position, the user may pull hood 80 rearwardly. A power-transmission coupling 160 (FIGS. 5-7) between hood 80 and lever 100 causes lever 100 to move to the full upright closed position of FIG. 3 when hood 80 is pulled closed. Alternatively, the user may close hood 80 by pressing forwardly on lever 100, thereby driving hood 80 rearward toward the closed position via coupling 160. A forward face 162 of first latch part 144 may be sloped to provide a lead-in for smooth re-engagement of latch mechanism 140. Second latch part 146 may also include a ramp or other lead-in for facilitating a smooth closing action and re-engagement of latch mechanism 140. Skilled persons will appreciate that latch mechanisms having other designs may include features different from sloped forward face 162 for providing smooth re-engagement of latch mechanism 140.

Security hood assembly 20 may further include a stop 170 for preventing hood 80 from moving rearwardly relative to body 30 from the closed position. In the preferred embodiment, stop 170 extends outwardly from a rear edge 174 (FIG. 5) of lever 100 to block an inner vertical wall 178 (FIG. 6) of hood 80. Stop 170 preferably also prevents forward rotation of lever 100 from the closed position. In an alternative embodiment, stop 170 may be connected to a different portion of holster 10, such as backing plate 66 or body 30, and may limit rearward rotation of hood 80 independently of the movement of lever 100. In yet other embodiments (not shown), stop 170 may be connected to backing plate 66 or body 30 to limit both rearward movement of hood 80 and forward movement of lever 100 from the closed position. Stop 170 may include any other means and devices for preventing movement of hood 80 rearward from the closed position and, in some embodiments, may also prevent movement of lever 100 in a direction opposite the direction in which lever 100 is moved to open hood 80.

Figure 5:
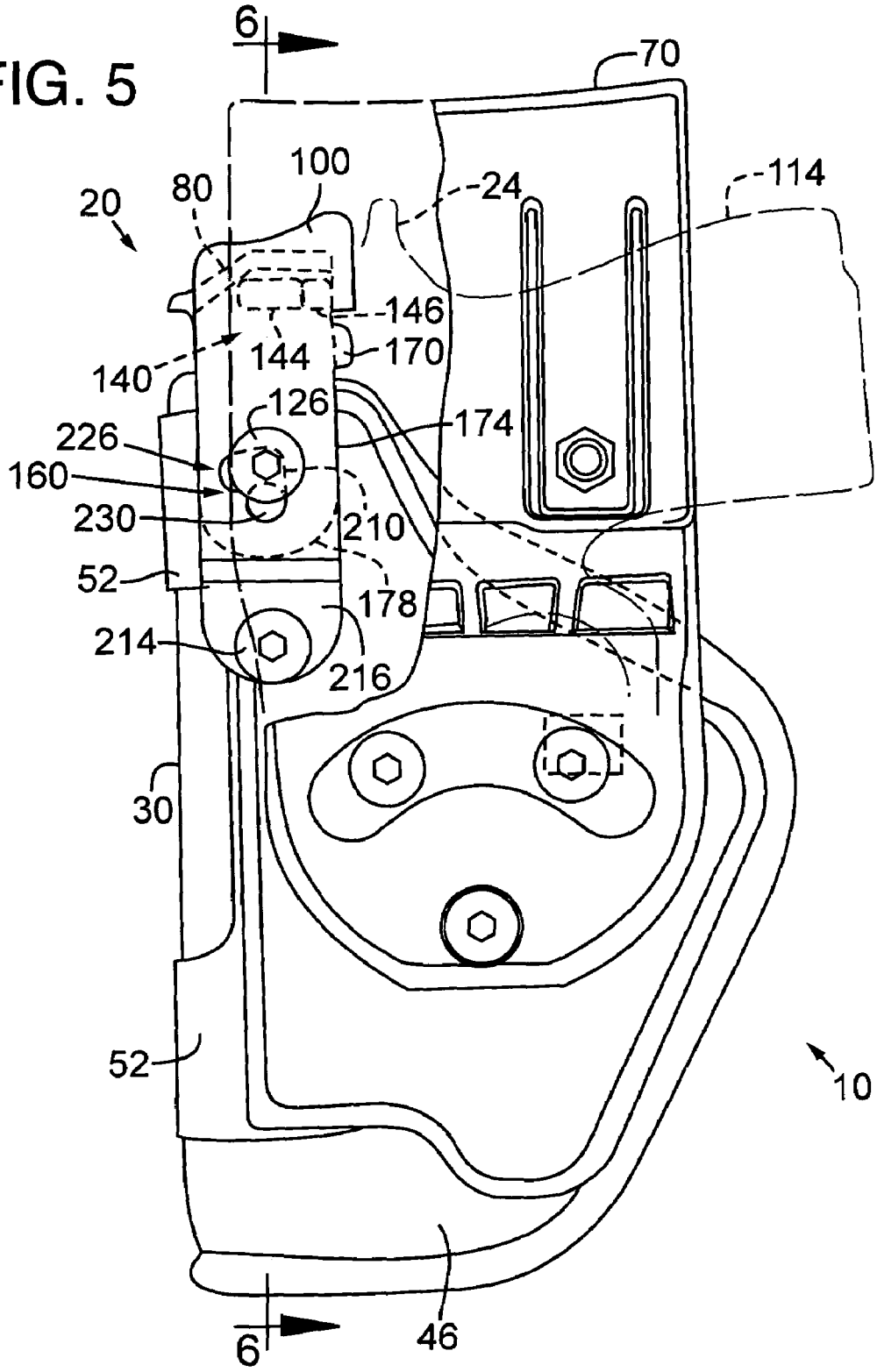
FIG. 5 is a inner side elevation view of the holster of FIG. 1, with a portion of a belt loop part of the holster broken away to reveal details of pivot mounts and a cam mechanism of the pivoting security hood assembly.
Figure 6:
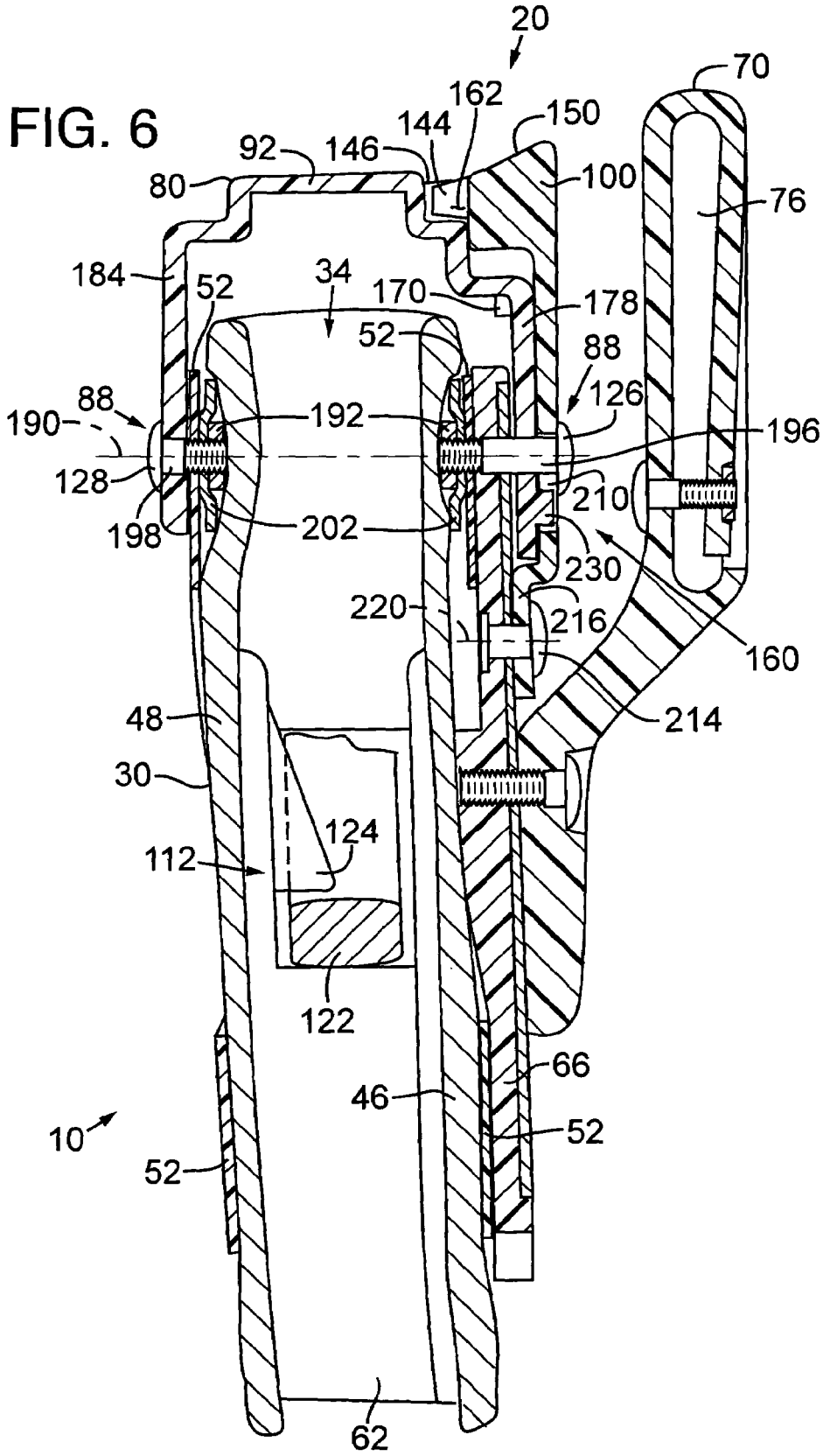
FIG. 6 is a cross-section view taken along line 6-6 of FIG. 5.

FIG. 5 is an inner side elevation view of holster 10 with a portion of belt loop 70 broken away to reveal details of coupling 160 and the mounting of security hood assembly 20 to body 30. FIG. 6 is a cross-section view taken along line 6-6 of FIG. 5. With reference to FIGS. 5 and 6, inner pivot pin 126 and outer pivot pin 128 rotatably couple hood 80 to body 30 for rotation about horizontal hood pivot axis 190. Inner and outer pivot pins 126 and 128 preferably comprise pan head or truss head machine screws that extend through inner and outer vertical walls 178 and 184 of hood 80 and are secured with thin nuts 192. Inner and outer pivot pins 126 and 128 preferably include smooth shanks 196 and 198, respectively, which are preferably sized to provide a smooth bearing surface for rotation of hood 80. In other embodiments, inner and outer pivot pins 126 and 128 may comprise rivets or other types of fasteners that include a generally cylindrical shank about which hood 80 can rotate. In still other embodiments, pivot pins 126 and 128 may be integrally formed or molded as part of body 30 and/or hood 80 to eliminate the need for separate fasteners and to allow snap-together assembly. Inner pivot pin 126 desirably extends through backing plate 66 and a portion of plastic frame 52 for providing sturdy support for hood 80. Outer pivot pin 128 preferably secures outer vertical wall 184 of hood 80 to an outer portion of plastic frame 52. Curved washers 202 may be provided for protecting nuts 192 from rubbing against inner and outer sidewalls 46 and 48 of body 30. Inner pivot pin 126 preferably extends through an inverted-L-shaped cam slot 210 in lever 100, which is described below in greater detail.

In the embodiment shown in FIGS. 1-7, lever 100 is rotatably attached to body 30 along inner sidewall 46. More specifically, a lever pivot pin 214 rotatably secures a lower portion 216 of lever 100 to backing plate 66 for rotation about a generally horizontal lever pivot axis 220. Lever pivot axis 220 is substantially parallel to hood pivot axis 190, and preferably aligned vertically with hood pivot axis 190, as shown. However, in alternative embodiments, lever pivot axis 220 may be located forward, rearward, or above hood pivot axis 190. In some embodiments hood pivot axis 190 and lever pivot axis 220 need not be parallel. In yet another embodiment (not shown), lever pivot axis 220 is coincident with hood pivot axis 190. In still other alternative embodiments, lever 100 is slidably mounted on body 30 or flexibly coupled to hood 80 to allow linear movement or other movement modes. The mounting location of hood 80 and lever 100 on holster 10, and the relative positions of hood pivot axis 190 and lever pivot axis 220 or slide way, will affect the configuration and structure by which lever 100 is coupled to hood 80.

In the preferred embodiment, lever 100 is coupled to hood 80 via power-transmission coupling 160, including a pin-in-slot type cam mechanism 226 (FIG. 5). Cam mechanism 226 includes inverted-L-shaped cam slot 210 in lever 100 and a cam follower 230 of hood 80 that extends from inner vertical wall 178 of hood 80 to engage cam slot 210. Cam follower 230 preferably includes a pin that is integrally molded with hood 80. However, in other embodiments, cam follower 230 comprises a separate part attached to inner vertical wall 178 or another part of hood 80. Cam follower 230 is sized to slide within a generally vertical first segment 236 (FIG. 10) of cam slot 210 in response to movement of lever 100 for transmitting power from lever 100 to hood 80 and vice versa. A generally horizontal second segment 238 (FIG. 10) of cam slot 210 extending transversely to first segment 236 provides clearance for inner pivot pin 126 (omitted from FIG. 10 to reveal details of cam mechanism 226) and does not actually function as a cam track or surface. Because cam follower 230 is offset from hood pivot axis 190, movement of lever 100 drives hood 80 forwardly, as described above with reference to FIGS. 2 and 3.

Figure 7:
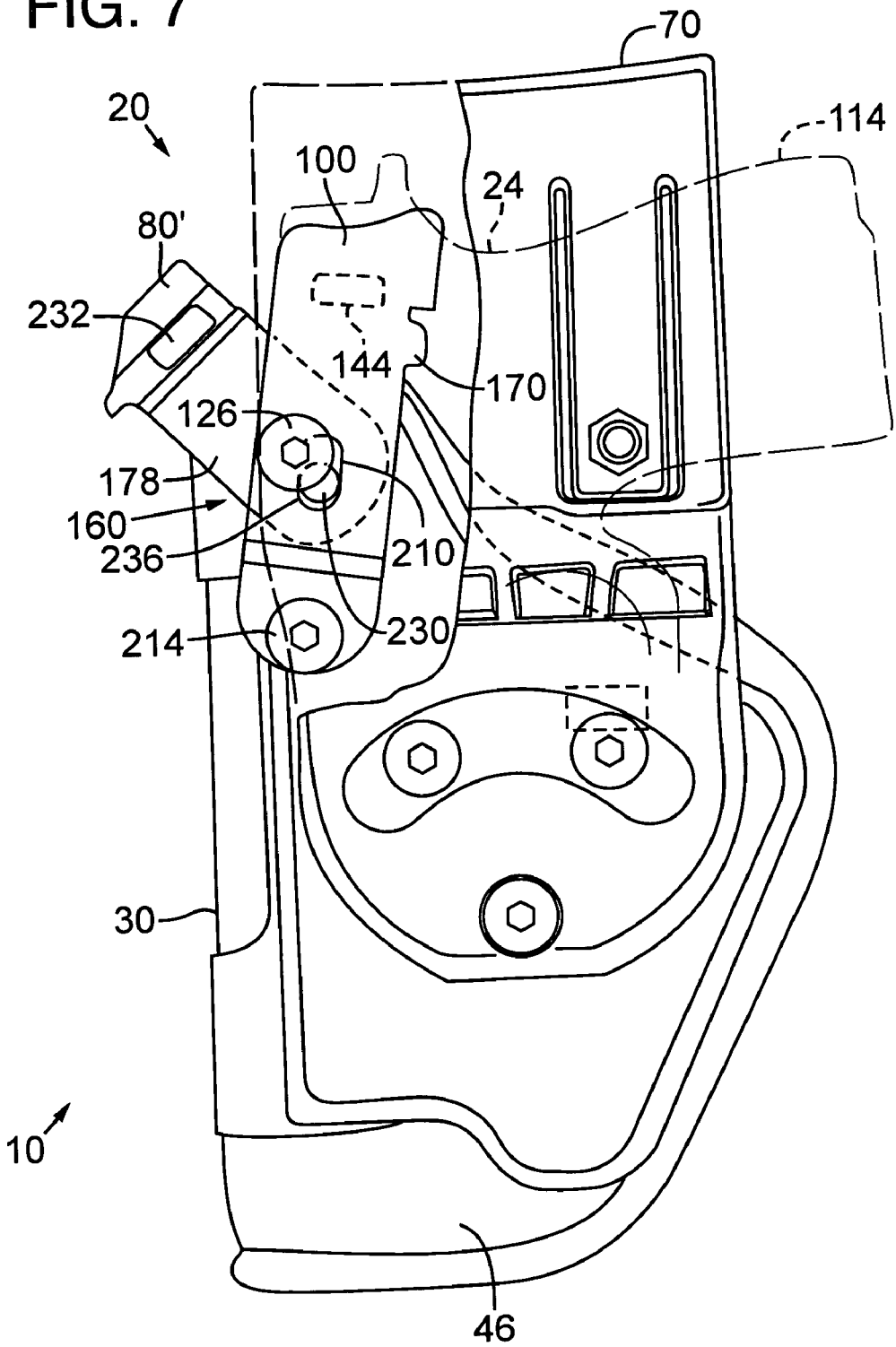
FIG. 7 is an inner side elevation view of an alternative embodiment of the holster of FIG. 1, in which a hood of the pivoting security hood assembly (shown in the open position) includes a window for engaging a corresponding latch pawl on a lever of the assembly.

FIG. 7 is a side elevation view of holster 10 showing a first alternative embodiment hood 80' rotated to the open position and lever 100 rotated rearward. Hood 80' differs from hood 80 of FIGS. 1-6 in that hood 80' includes a window 232 in place of second latch part 146. Window 232 is sized to engage first latch part 144 of lever 100 when lever 100 and hood 80' are in the closed position, in a manner similar to first and second latch parts 144 and 146 of FIGS. 1-5.

In FIG. 7, hood 80' and lever 100 are shown in the open position, to illustrate the operation of cam mechanism 226. As shown in FIG. 7, when lever 100 is rotated rearward, cam follower 230 slides generally upwardly along first segment 236 of cam slot 210 and generally rearward of hood pivot axis 190 (FIG. 6), causing hood 80' to rotate forwardly relative to body 30.

Mechanisms different from the pin-in-slot type cam mechanism 226 may also be employed in security hood assembly 20 for operably coupling lever 100 to hood 80, so that hood 80 is moved forwardly in response to manual movement of lever 100. For example, the coupling 160 between lever 100 and hood 80 may include another kind of cam drive mechanism or a gear drive mechanism, such as the one shown in FIGS. 8 and 9. Advantageously, a cam drive or gear drive may also result in movement of hood 80 from the open position toward the closed position in response to returning lever 100 to the closed position. In yet other embodiments, such as the embodiments of FIGS. 21, 22, 27, and 28, described below, lever 100 releasably locks hood 80 in the closed position, but does not drive hood 80. In such embodiments, security hood assembly 20 preferably includes a device separate from lever 100 for urging hood 80 forwardly in response to movement of lever 100, such as the biasing mechanisms described below with reference to FIGS. 10-14, 27, and 28.

FIGS. 8-28 depict further embodiments of holster 10 and security hood assembly 20. In the embodiments of FIGS. 8-28, body 30' of holster 10 is molded or formed of a thermoplastic resin to form a hard structure. Suitable resins include nylon 6 (with or without glass reinforcement filling); CAPRON® brand nylon sold by BASF Corporation, Mount Olive, N.J., USA; and KYDEX® brand acrylic/PVC alloy sold by Kleerdex Company of Aiken, S.C., USA. The sides of body 30' are preferably shaped to snugly fit handgun 24 and to engage or pinch its trigger guard to provide a supplemental handgun retention feature 244 (best shown in FIGS. 17 and 19). The molded construction of body 30' may eliminate the need for the curved washers 202 of FIG. 6 and may include bosses along an inside surface of body 30' for seating and protecting nuts 192 (FIG. 6) or rivet heads. In some embodiments, stops may be molded or formed in or on the outer surfaces of the inner and outer sidewalls 46 and 48 of body 30' adjacent hood pivot axis 190 to prevent over-rotation of hood 80 or to eliminate the need for the stop 170 of FIGS. 1-7. For example, FIGS. 13, 14, 21, 22, and 23, among others, depict a J-shaped stop lip formed in body 30' around the hood pivot hole along the ends of the downwardly depending sidewalls of hood 80. The J-shaped stop lip establishes forward and rearward limits of rotation for hood 80.

Figure 8:
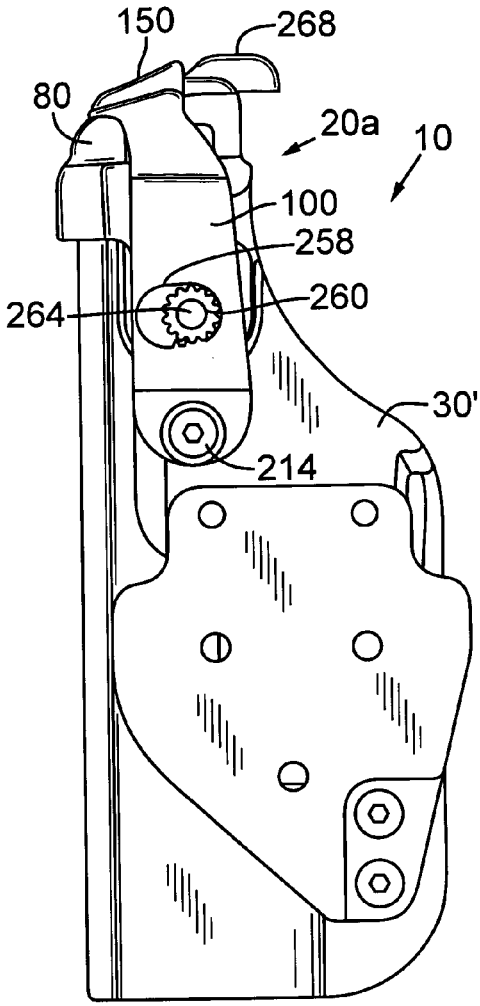
FIG. 8 is an inner side elevation view of a holster in accordance with a second embodiment, including a gear drive mechanism for operably coupling the lever to the hood.

FIG. 8 is an inner side elevation view of holster 10 and security hood assembly 20*a* in accordance with a second embodiment, including a gear drive mechanism 250 for operably coupling lever 100 to hood 80. Gear drive mechanism 250 includes a rack 254 formed along an arcuate lower edge of a slot 258 in lever 100. A pinion gear 260 of gear drive mechanism 250 is centered on the pivot axis of hood 80 and meshes with rack 254 so that pinion gear 260 is rotatably driven in response to rearward movement of lever 100. A hood pivot pin, omitted from FIG. 8 for clarity, extends through a hole 264 in hood 80 centered on pinion gear 260. In FIG. 8, hood 80 is shown in the closed position. Other details of security hood assembly 20*a*, such as its latch mechanism, for example, may be similar to the embodiment of FIGS. 1-6.

Figure 9:
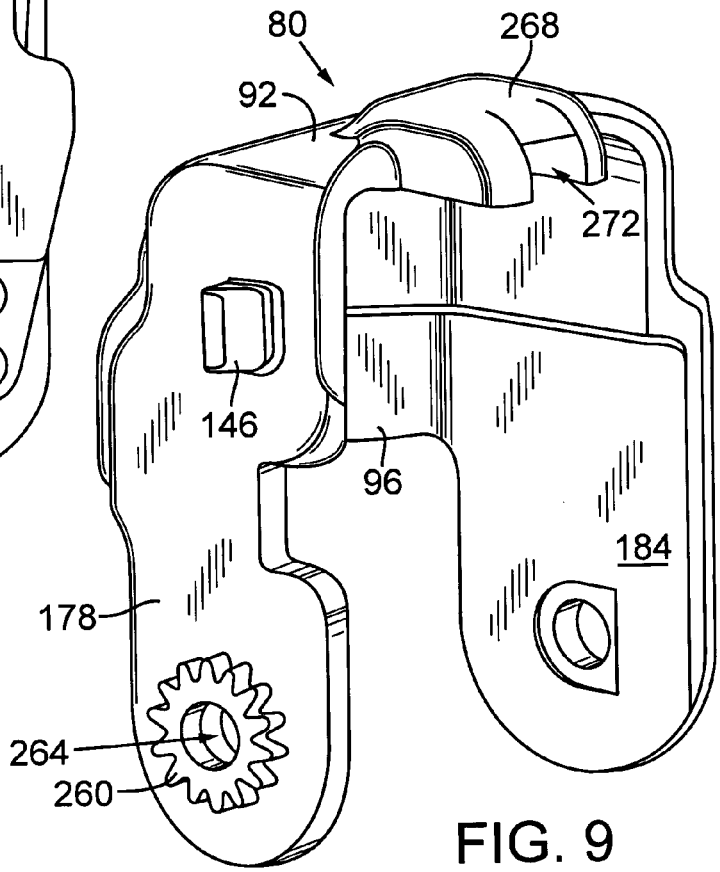
FIG. 9 is an enlarged isometric view of the hood of FIG. 8 showing detail of a pinion gear of the drive mechanism.
Figure 10:
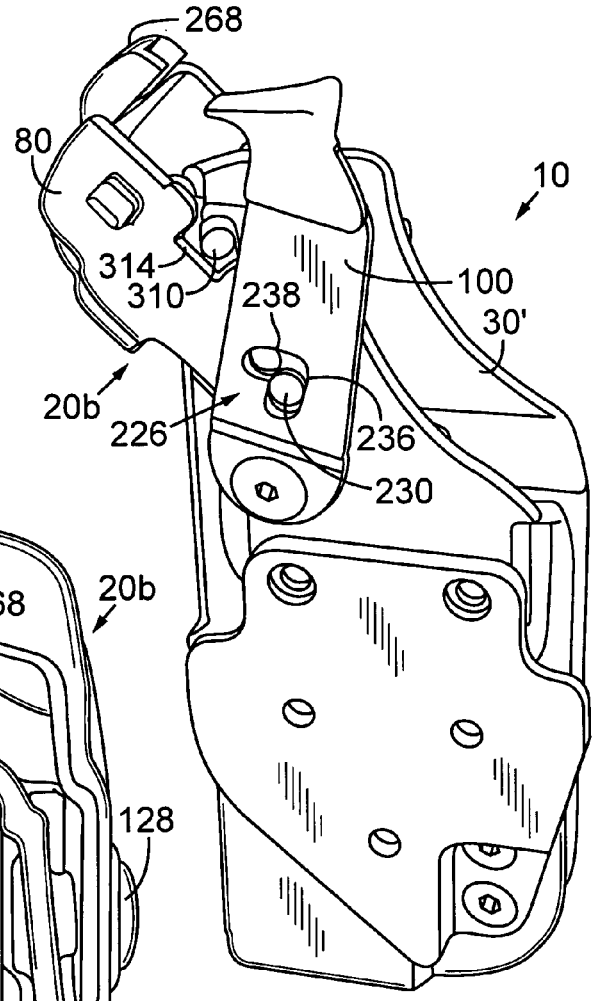
FIG. 10 is a perspective view of a holster in accordance with a third embodiment, with the hood shown in the open position.

FIG. 9 is an enlarged isometric view of hood 80 of FIG. 8 showing detail of pinion gear 260 and hole 264. With reference to FIG. 9, pinion gear 260 is affixed to hood 80 along inner vertical wall 178 of hood 80 and may be formed of a unitary molded construction with hood 80 or with inner vertical wall 178 thereof. In this second embodiment, hood 80 features a hammer guard section 268 that extends rearward from spanning portion 92 of hood 80 to cover the hammer when handgun 24 (FIG. 15) is holstered in the cocked-and-locked condition. Hammer guard section 268 is also preferably formed of unitary molded construction with hood 80. Hammer guard section 268 protects the hammer of handgun 24 from impacts, and also provides a convenient region for molding a blocking feature 272 (FIG. 12) into hood 80 for preventing the hammer from accidentally falling from the cocked-and-locked position. In a mold for fabricating hood 80, a mold insert can be conveniently changed to alter the shape and position of blocking feature 272 to fit a particular model of handgun 24, without changing the outward appearance of hammer guard section 268. Thus hammer guard section 268 may facilitate the use of a single mold to make multiple different hoods, customized to fit particular handgun and hammer shapes.

Blocking feature 272 may also be sloped or shaped so that, in the event that a holstered handgun's hammer is accidentally released against blocking feature 272, the handgun 24 can be removed from holster 10 without discharging. Blocking feature 272 may be shaped or angled so as to provide a track along which the hammer smoothly rides while hood 80 is slowly opened, to thereby gently release the hammer and reduce the force of the hammer against the firing pin to avoid discharging the firearm.

Figure 11:
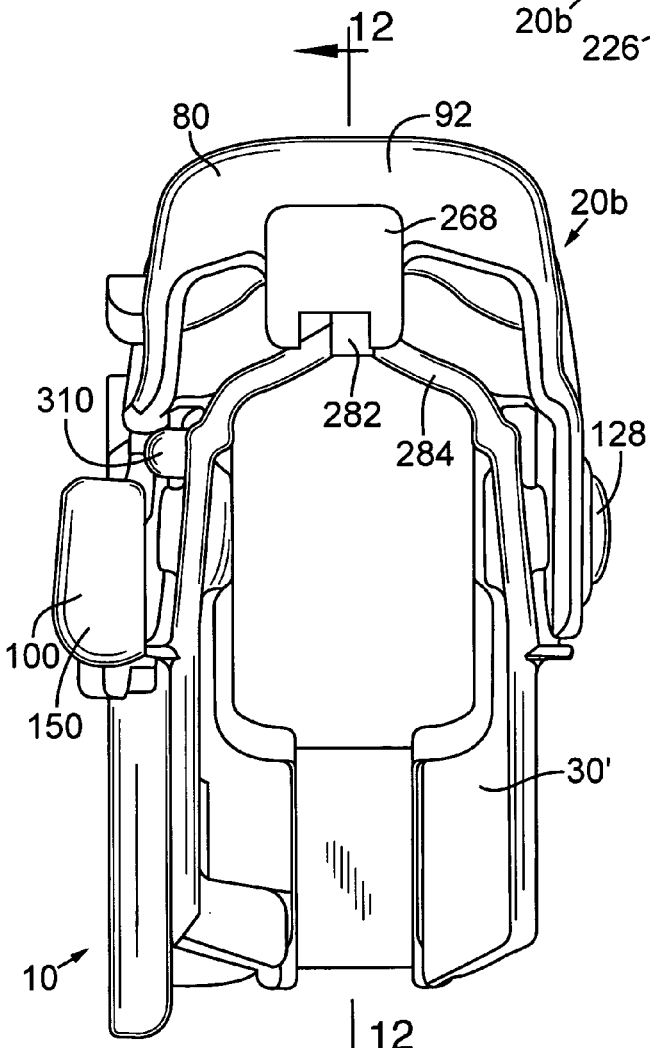
FIG. 11 is a top plan view of the holster of FIG. 10.
Figure 12:
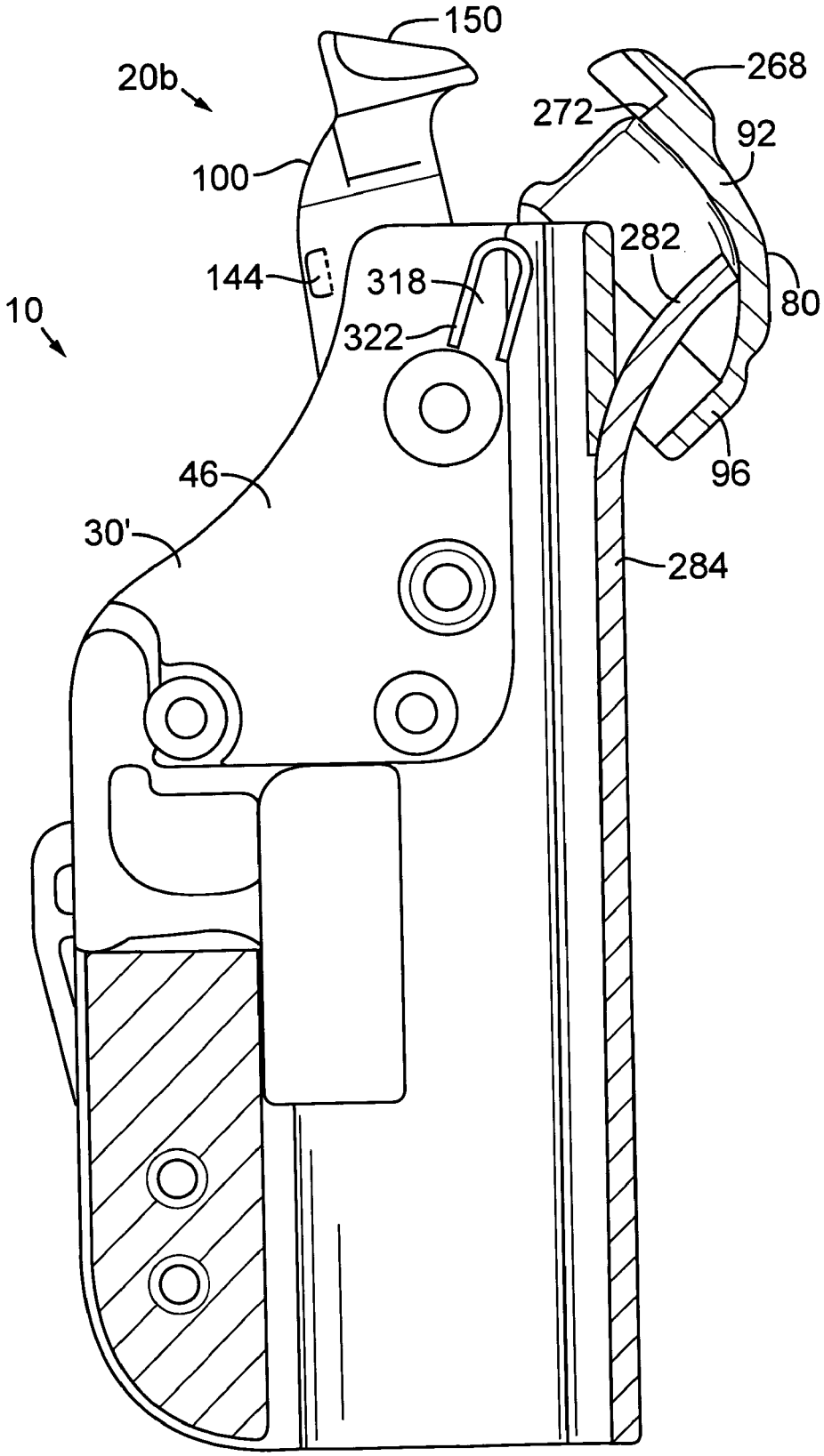
FIG. 12 is a cross section view of the holster of FIG. 10 taken along line 12-12 of FIG. 11.
Figure 13:
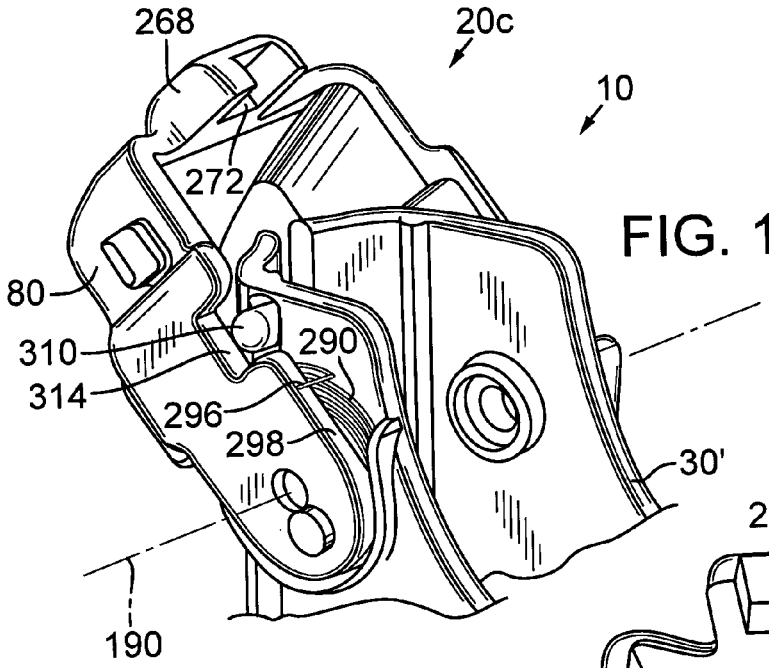
FIG. 13 is an enlarged detail perspective view of the top portion of a fourth embodiment holster including a coil spring for biasing the hood relative to the body of the holster toward the open position shown.
Figure 14:
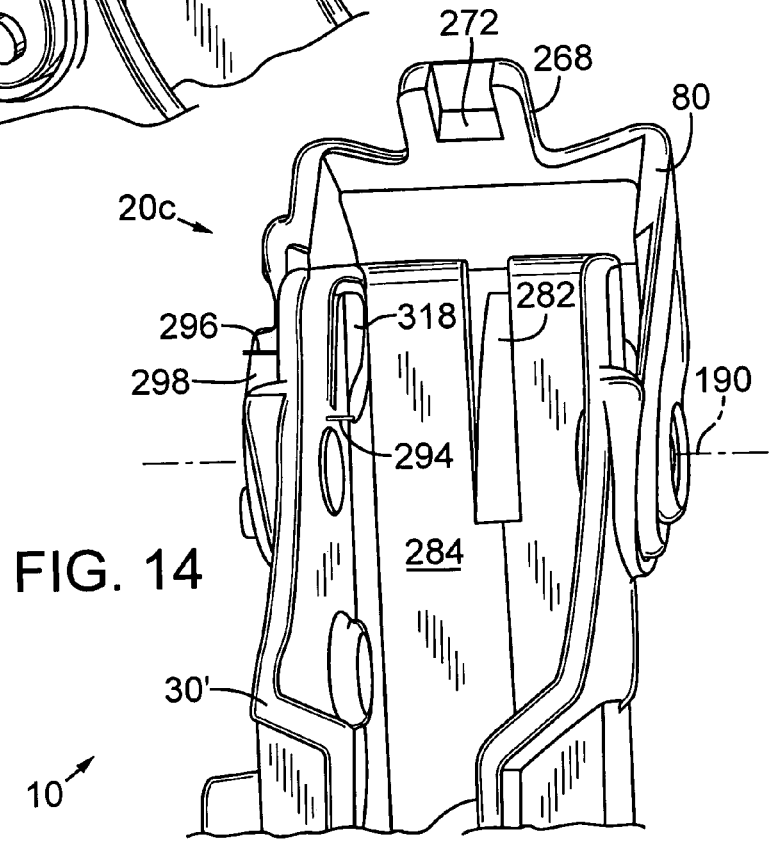
FIG. 14 is an enlarged detail perspective view of a top portion of the holster of FIG. 13 shown from the rear to reveal a leaf spring element of the body, which operates to urge the hood forward.

In some embodiments, hood 80 is biased toward the open position by a spring, elastic band, or other biasing mechanism, so that hood 80 will automatically open after latch mechanism 140 is released. In other embodiments, a similar biasing mechanism does not to automatically open hood 80, but assists a user's manual lever-controlled opening or closing of hood 80, or merely biases hood 80 to prevent hood 80 from swinging or being inadvertently closed, once unlatched and open. Such a biasing mechanism is preferably interposed between and operably associated with hood 80 and body 30, but may also be operably associated with lever 100 instead of hood 80 or instead of body 30. For example, FIGS. 11, 12, and 14 depict a biasing mechanism for a security hood assembly 20*b* including a leaf spring 282 that is integrally formed in a forward spine portion 284 of body 30. Leaf spring 282 extends forwardly of spine 284 to urge hood 80 forwardly toward the open position, as shown in FIGS. 11 and 12. FIGS. 13 and 14 depict another embodiment of a biasing mechanism for a security hood assembly 20*c* including a coil spring 290 for urging hood 80 forwardly toward the open position shown. A first end 294 (FIG. 14) of coil spring 290 is lodged in body 30'. Coil spring 290 is preloaded so that a second end 296 thereof presses against a rearward edge 298 of inner vertical member 178 of hood 80 to urge hood 80 forwardly toward the open position. Other biasing mechanisms may be interposed between hood 80 and lever 100, or between other parts of holster 10, such as between hood 80 and a holster mounting plate 66 or belt loop 70, for example.

In some embodiments (not shown), the direction of biasing force may be reversed so that a spring or other biasing mechanism opposes the movement of hood 80 toward the open position and tends to assist or cause closure of hood 80. In yet other embodiments, biasing force may be effected for one or more portions of the travel of hood 80.

Security hood assembly 20 (including 20*a*, 20*b*, 20*c*, etc.) may include lobes, ridges, detents, spring members or other features that are formed in or applied to hood 80 and/or body 30 and operably adapted to engage during selected portions of the travel (throw) of hood 80 as it moves between the open and closed positions. In one embodiment, one or more lobes or detents is formed on an inside surface or arcuate lower edge of inner vertical wall 178 and/or of outer vertical wall 184 of hood 80. One or more recesses or detent grooves is formed on an outer surface of body 30 and positioned for engagement with the lobe or detent during a selected portion of the rotary movement of hood 80. For example, a lobe and a recess may be located on the respective hood 80 and body 30 so as not to interfere with movement of hood 80 from the vertical fully closed position to a half-open position, but to begin engaging after the hood reaches the half-open position and to urge hood 80 from the half-open position to the fully open position. Alternatively, a lobe or detent and an associated recess or groove may be positioned to apply biasing force as hood 80 is nears the closed position when rotated rearward from the open position, thereby causing positive engagement of latch mechanism 140 without requiring manual force on lever 100 as it nears the vertical position.

FIGS. 10-14 depict an embodiment of holster 10 with a security hood assembly 20*c* including a spring lobe 310 that moves into a notch 314 along rearward edge 289 of hood 80 when hood 80 is in the open position, to thereby resist closing of hood 80. For clarity, inner pivot pin 126 for hood 80 is omitted from FIGS. 10-14, and lever 100 and outer pivot pin 128 are omitted from FIGS. 13 and 14. With reference to FIGS. 10-14, lobe 310 preferably includes a hemispherical button (best shown in FIG. 11) at the end of a spring arm 318 (FIG. 12) integrally formed in body 30'. Spring arm 318 is preferably formed by molding or cutting a U-shaped slot 322 (FIG. 12) in inner sidewall 46 of body 30'. U-shaped slot 322 provides clearance around the perimeter of spring arm 318 to allow spring arm 318 to flex inwardly when hood 80 is closed. In the embodiment of FIGS. 10-14, other details of security hood assembly 20*b*, such as its latch mechanism, for example, may be similar to the embodiment of FIGS. 1-6.

Figure 15:
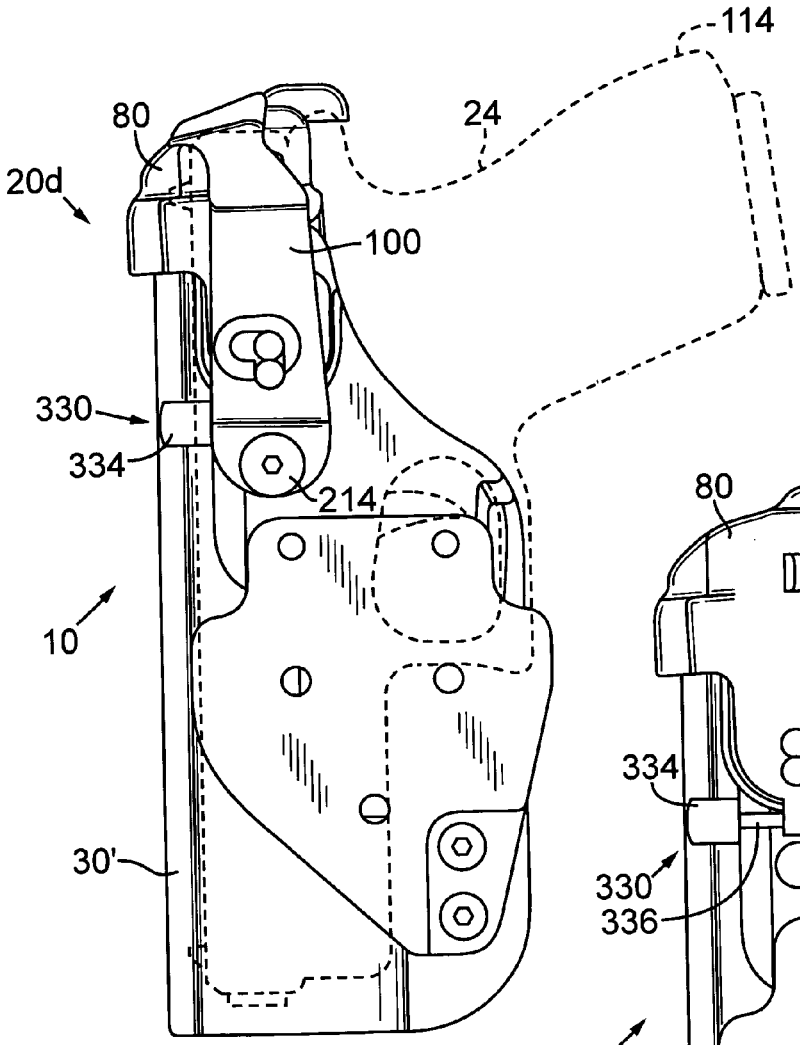
FIG. 15 is an inside elevation view of a fifth embodiment holster with its security hood assembly in the closed position and illustrating a holstered handgun in broken lines.
Figure 16:
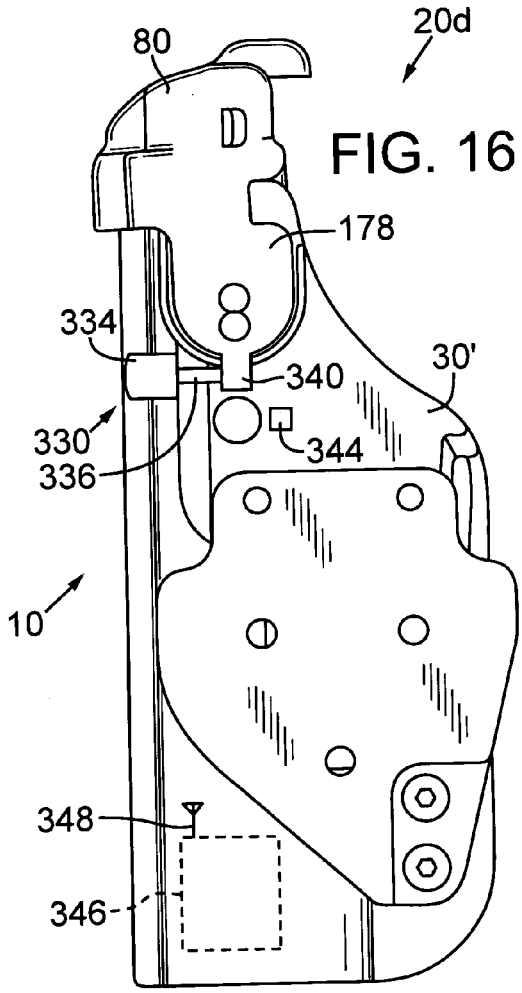
FIG. 16 is an inside elevation view of the holster of FIG. 15 with the thumb lever removed to show detail of a drive mechanism for actuating the hood.

FIGS. 15 and 16 are inside elevation views of holster 10 including a security hood assembly 20*d* according to yet another embodiment. With reference to FIGS. 15 and 16, security hood assembly 20*d* includes a drive mechanism 330 operably associated with hood for driving hood toward the open position. Drive mechanism 330 may comprise a solenoid 334 having a plunger 336 that is driven against a drive tab 340 (FIG. 16) depending downwardly from inner vertical wall 178 of hood 80 below its pivot axis 190 (FIGS. 6, 13, and 14). Solenoid 334 may be activated by an electronic device 346 (FIG. 16) housed within holster body 30' or otherwise associated with holster 10. For example, security hood assembly 20*d* may be operably associated with a switch that activates electronic device 346 when lever 100 is moved to unlatch security hood assembly 20*d* or open hood 80. In one embodiment, a first electrical contact may be formed on an inner surface of lever 100 facing holster body 30' and be positioned to wipe against a second electrical contact 344 (or switch) located on inner side surface of body 30 adjacent lever pivot pin 214 (FIG. 15). The first and second electrical contacts may open or close a circuit or switch in response to movement of lever 100, to thereby activate electronic device 346 for actuating drive mechanism 330. In other embodiments, a switch associated with security hood assembly 20 (including 20*a*, 20*b*, 20*c*, etc.) may be used for activating a different kind of electronic device, such as electronic circuitry of a holstered service item or a computer controlled device integrated with holster 10, for example.

With reference to FIG. 16, electronic device 346 may include a signaling device contained in holster body 30' that sounds an audible alarm or alerts a central station via a radio frequency signal transmitter and antenna 348, in response to actuation of security hood assembly 20 and switch 344. Electronic device 346 may also be located in other places on holster 10 or be separate from but coupled to holster 10, and may be carried by a user on a duty belt 74 (FIG. 1), for example. Hood 80 may also include one or more electronic contacts that contact metal pins or pads on a holstered service item to close or short a circuit in the service item when hood 80 is in the closed position. In this way, opening of hood 80 can automatically activate a service item only when needed and conserve battery power when the service item is holstered. For example, opening of hood 80 may cause a holstered service item such as a radio, stun gun, or tactical illuminator to be switched to a stand-by mode. Alternatively, one or more first electrical contacts may be provided on hood 80 or lever 100 and one or more second electrical contacts may be provided on body 30 or another part of holster 10. First and second electrical contacts may be positioned to cooperate at one or more selected portions of the travel of hood 80 (e.g., at all positions other than the closed position), to activate an electronic device, such as an alarm, a radio-frequency signaling device, a biometric authentication device, or other circuitry of holster 10 or a holstered service item.

In one embodiment, a switch or electrical contacts associated with security hood assembly 20 trigger electronic device 346 to power-up an integrated GPS receiver to acquire GPS satellite signals (e.g. via antenna 348). Switches or contracts operated by security hood assembly 20 may also trigger an integrated mobile telephone device or radio transmitter associated with the GPS receiver to go to a stand-by mode for signaling a dispatch center or tactical operations communication facility. A second switch may be provided for activating a second function of electronic device 346 upon drawing of a handgun 24 or other service item from holster 10. The second function may include logging or transmitting of position data, time data, and officer ID information, for example. Thus, actuation of security hood assembly 20 may put a GPS receiver and cell phone into a stand-by mode to prevent delays in acquiring remotely broadcast signals needed to acquire and transmit position data, time data, officer identification information, and other data to the dispatch center or tactical operations communication facility, when the handgun or other service item is subsequently drawn from holster 10.

Figure 17:
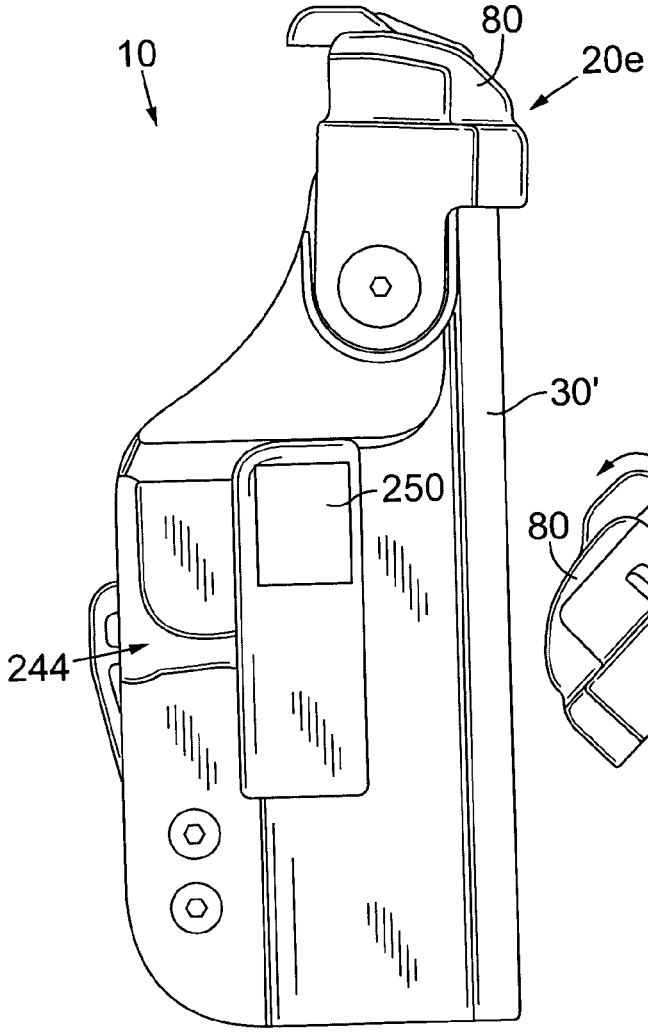
FIG. 17 is an outside elevation view of a sixth embodiment holster including a security hood assembly and a biometric authentication device.

Security hood assembly 20 (including 20*a*, 20*b*, 20*c*, etc.) may be used in conjunction with a radio-frequency key device or a biometric authentication device similar to the one sold under the trademark PRO-4™ by Michaels of Oregon Company, the assignee of the present application, and described in U.S. Pat. No. 6,641,009 of French et al., which is incorporated herein by reference. When a biometric authentication device is used, hood 80 may be locked and unlocked by a blocking device driven by an actuator responsive to electronic signals generated by the biometric authentication device upon verification of a unique biometric characteristic of the user, such as a fingerprint, for example. Authentication of an authorized user via a biometric authentication device may also trigger an internal handgun retention device to release a holstered handgun or service item, as described in the '009 patent. Use of a radio-frequency key device with security hood assembly 20 allows the biometric authentication device to be controlled remotely, for changing user permissions, operational configuration, etc., in response to receipt at the holster of radio-frequency signals from a remote control device. FIG. 17 is an outside elevation view of an embodiment of security hood assembly 20*e* including a fingerprint scanner 350 in accordance with the '009 patent. As shown in FIG. 17, security hood assembly 20*e* may be similar to security hood assembly 20*d* of FIGS. 15 and 16, but may omit lever 100, relying solely on biometric identification via fingerprint scanner 350 to activate drive mechanism 330 for unlatching and driving hood 80 to the open position. Alternatively, holster 10 may be configured with two independent security devices: (1) fingerprint scanner 350 coupled to an internal retention device; and (2) security hood assembly 20*e* including a lever 100 and latch 140 for manually operating hood 80.

Figure 18:
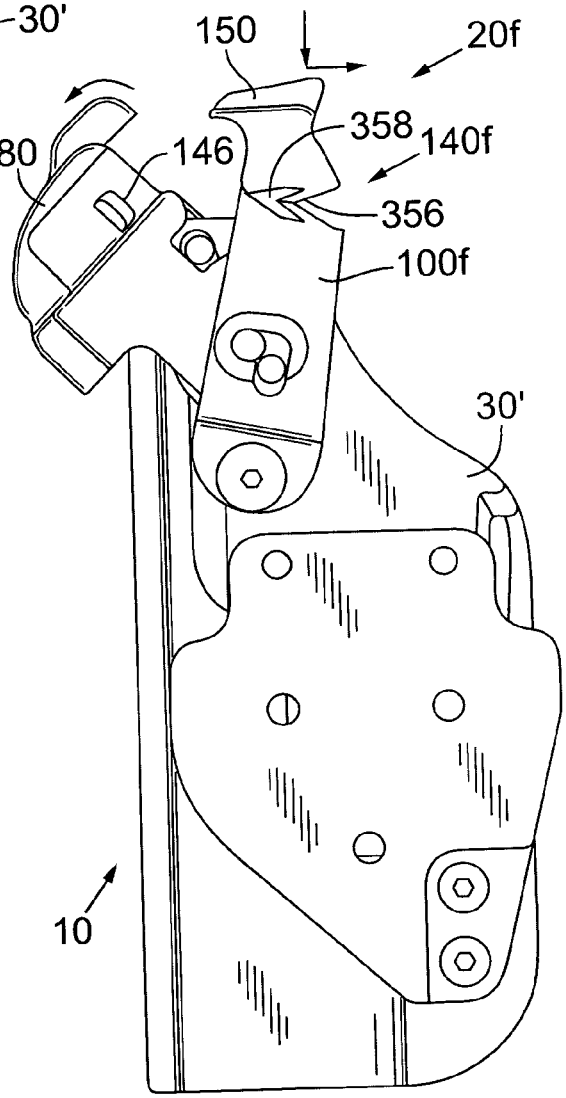
FIG. 18 is an inside elevation view of a seventh embodiment holster including a lever that is pressed downwardly to release a latch of the security hood assembly.

FIG. 18 is an inside elevation view of yet another embodiment of security hood assembly 20*f*, including an alternative latch mechanism 140*f*. With reference to FIG. 18, latch mechanism 140*f* includes a first latch part (similar to first latch part 144 of FIGS. 1-7) formed on an outer side surface of lever 100*f*. Latch mechanism 140*f* further includes a second latch part 146 formed on hood 80 that engages with the first latch part when lever 100*f* and hood 80 are in the closed position to releasably lock hood 80. Latch mechanism 140*f* is released via a living spring 356 formed in lever 100*f*. Living spring 356 flexes in response to downward force applied to thumb pad portion 150 of lever 100*f*, causing the first latch part to move out of alignment relative to second latch part 146. Thereafter, lever 100*f* may be swept rearward to open hood 80. This embodiment of security hood assembly 20*f* may reduce or eliminate inward movement of the lever required to release the latch mechanism 140 of the embodiments of FIGS. 1-12. A soft insert 358 of elastomer or other resilient compressible material may be included for filling one or more openings in living spring 356. Soft insert 358 may be inserted or overmolded during a secondary molding operation or during molding of lever 100*f*. Soft insert 358 may have a hardness selected to alter the spring force of living spring 356 to suit a user's specifications, without requiring a redesign of living spring 356. Soft insert 358 may also have a color that contrasts with the color of lever 100*f*, to provide a visually suggestive indicator of the function of living spring 356 and soft insert 358.

Figure 19:
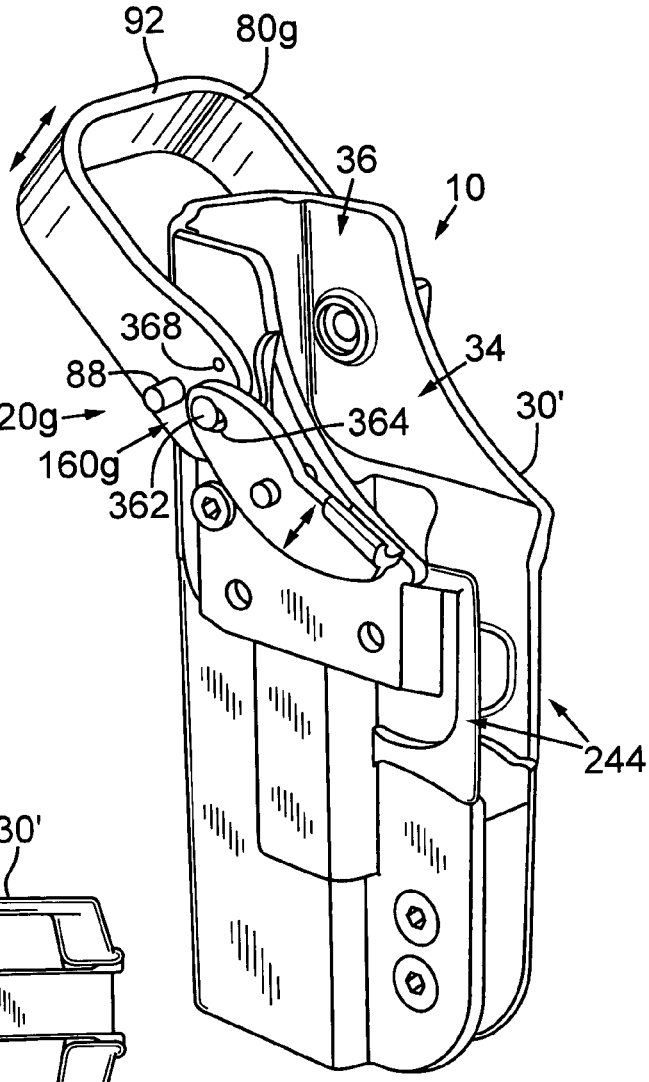
FIG. 19 is a perspective view of a holster in accordance with an eighth embodiment, including an aft-extending lever that is pressed downwardly to drive the hood toward the open position shown.
Figure 20:
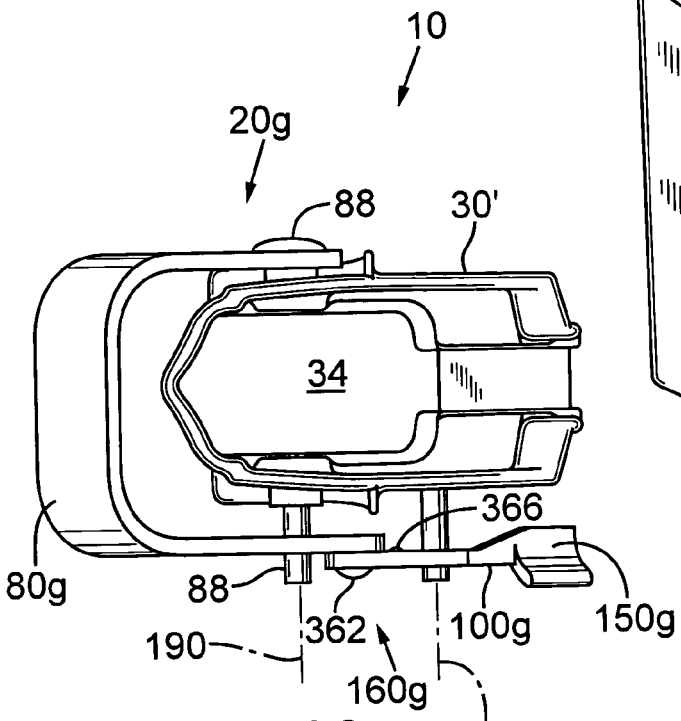
FIG. 20 is a top plan view of the holster of FIG. 19.

FIGS. 19 and 20 are respective perspective and top plan views of holster 10 including still another embodiment of security hood assembly 20*g*. With reference to FIGS. 19 and 20, security hood assembly 20*g* includes a hood 80*g* comprising a rigid inverted-U-shaped bail that spans between inner and outer pivot joints 88 on a hood pivot axis 190 (FIG. 20). Hood 80*g* is shown in the open position. The closed position (not illustrated) involves the hood being oriented generally in alignment with holster body 30' to span over the top opening 36 of cavity 34. Hood 80*g* includes a spanning portion 92, but omits the front skirt portion 96 of the embodiments of FIGS. 1-18. In an alternative embodiment (not shown) hood 80*g* may be replaced with a different hood offering benefits similar to the hoods shown in FIGS. 1-7 or FIGS. 8-18, for example. A lever 100*g* of security hood assembly 20*g* is pivotably mounted to body 30' for rotation about a lever pivot axis 220*g* that is spaced apart horizontally relative to hood pivot axis 190. Lever 100*g* includes a thumb pad portion 150*g* that is positioned rearward of lever pivot axis 220*g*. To open hood 80*g*, a user presses downwardly on thumb pad portion 150*g* to drive hood 80*g* via coupling 160*g*. Coupling 160*g* comprises pin 362 that couples hood 80*g* to a slot 364 in the end of lever 100*g* opposite thumb pad portion 150*g*. Pin 362 slides along slot 364 as lever 100*g* is rotated in a manner similar to cam mechanism 262 of FIGS. 1-7 and 10-12. A latch mechanism for releasably holding hood 80*g* in the closed position includes a detent bump 366 (FIG. 20) formed along a surface of lever 100*g* facing holster body 30' and a detent recess 368 (FIG. 19) formed along an outer surface of hood. Detent bump 366 seats in detent recess 368 when hood 80*g* is moved to the closed position. Other latch mechanisms may also be used with security hood assembly 20*g*.

Figure 21:
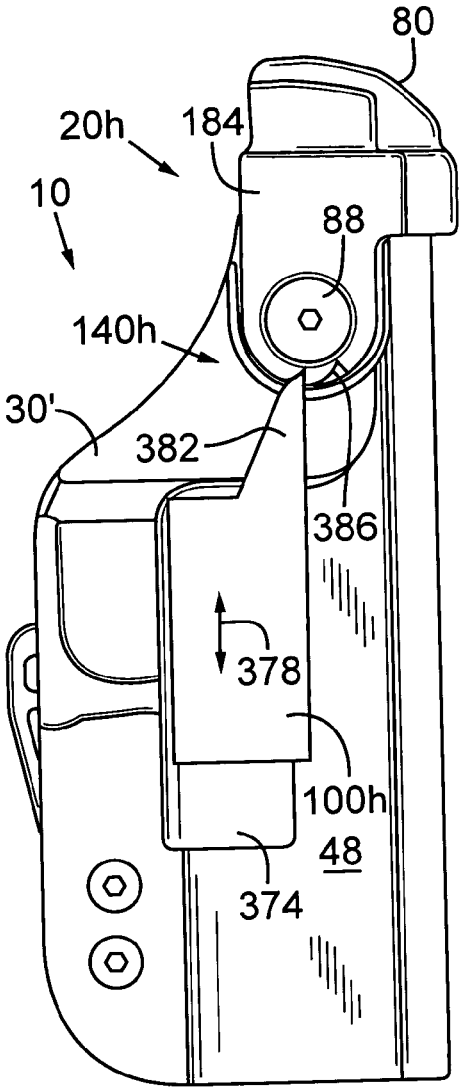
FIG. 21 is an outside elevation view of a holster with an index finger slide lever for releasably latching the security hood assembly, shown in the closed position.
Figure 22:
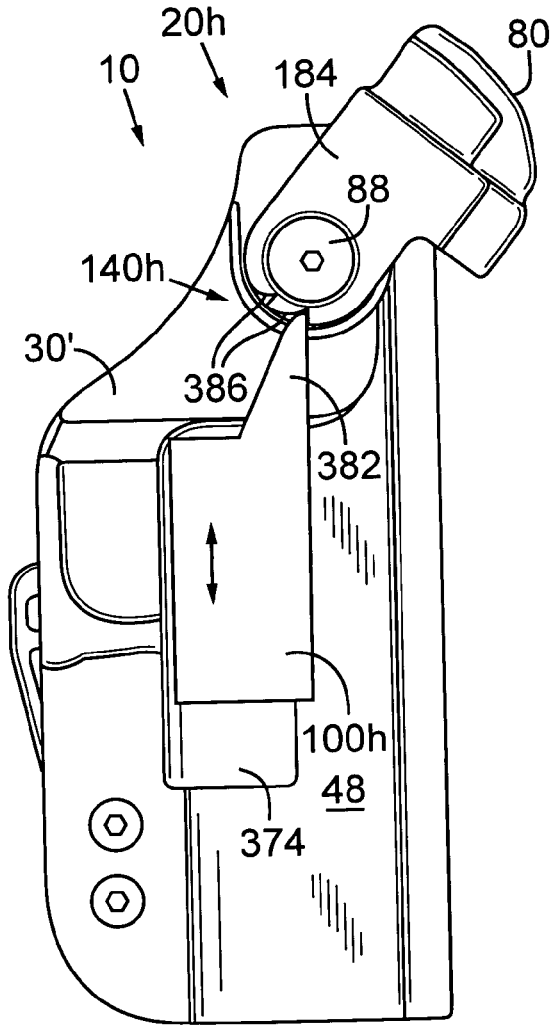
FIG. 22 is an outside elevation of the holster of FIG. 21 shown with its hood releasably locked in the open position.

FIGS. 21 and 22 are outside elevation views of holster 10 including a security hood assembly 20*h* in accordance with another embodiment. With reference to FIGS. 21 and 22, a lever 100*h* of security hood assembly 20*h* is mounted along outer sidewall 48 of body 30' for manual actuation with the user's index finger. Lever 100*h* is mounted on a slide way 374 for sliding movement in the direction shown by arrows 378 to release a latch 140*h*. Latch 140*h* includes a pawl extension 382 of lever 100*h* that engages one or more notches 386 in an outer vertical wall 184 of hood 80. Security hood assembly 20*h* may include the leaf spring 282 and/or coil spring 290 of FIGS. 10-13 for driving hood 80 from the closed position (FIG. 21) to the open position (FIG. 22) in response to sliding of lever 100*h* downwardly to release latch 140*h*. In other embodiments, hood 80 may be power-driven, such as in the embodiment of FIGS. 15 and 16, for example. A spring or other slide biasing device (not shown) may be provided to urge lever 100*h* upwardly for returning lever 100*h* to the latched position.

Figure 23:
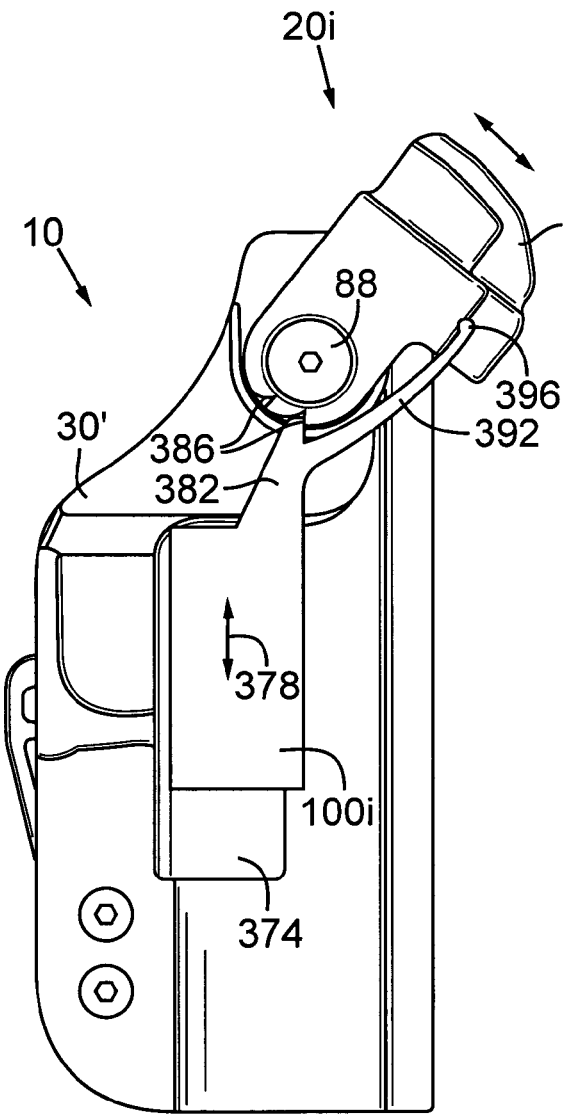
FIG. 23 is an outside elevation view of a holster with another slide lever mechanism, including a linkage arm coupled to the hood for driving the hood forwardly toward the open position shown, in response to downward movement of the slide.
Figure 24:
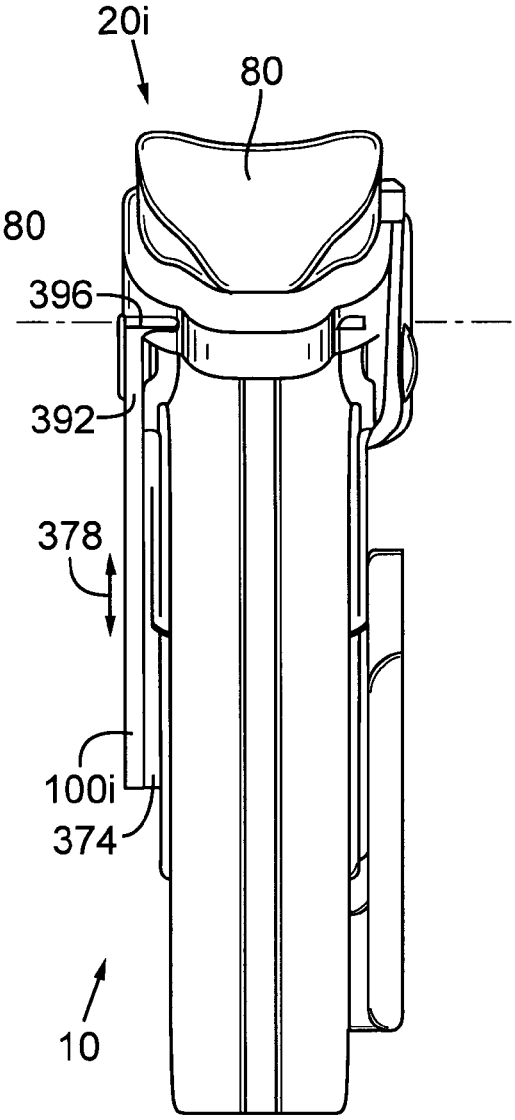
FIG. 24 is a front elevation view of the holster of FIG. 23.

FIGS. 23 and 24 are respective outside elevation and front elevation views of an alternative embodiment security hood assembly 20*i* similar to the embodiment of FIGS. 21 and 22, but further including a drive linkage 392 that transmits a drive force from sliding lever 100*i* to hood 80 for driving hood from the closed position (not shown) to the open position shown, in response to downward sliding movement of lever 100*i*. Lever 100*i* includes a horizontally-extending drive rod 396 at the distal end of flexible linkage 392, which extends through a hole in a forward portion of hood 80 forward of pivot joint 88. Downward sliding movement of lever 100*i* along slide way 374 simultaneously releases the latch 140*h* and pulls downwardly on the front portion of hood 80 via linkage 392 and drive rod 396, to rotate hood 80 toward the open position.

Figure 25:
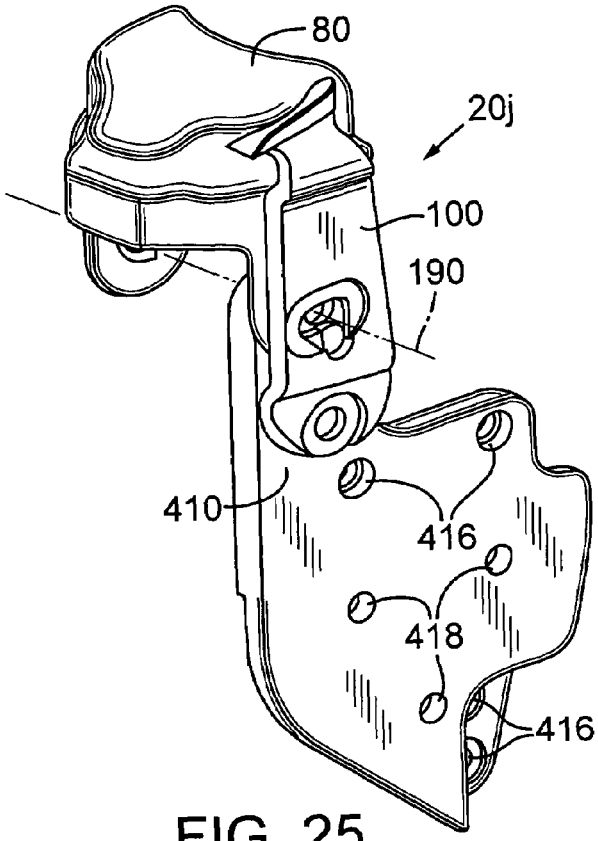
FIG. 25 is a front perspective view of a security hood assembly supported on a holster mounting platform, in accordance with another embodiment.
Figure 26:
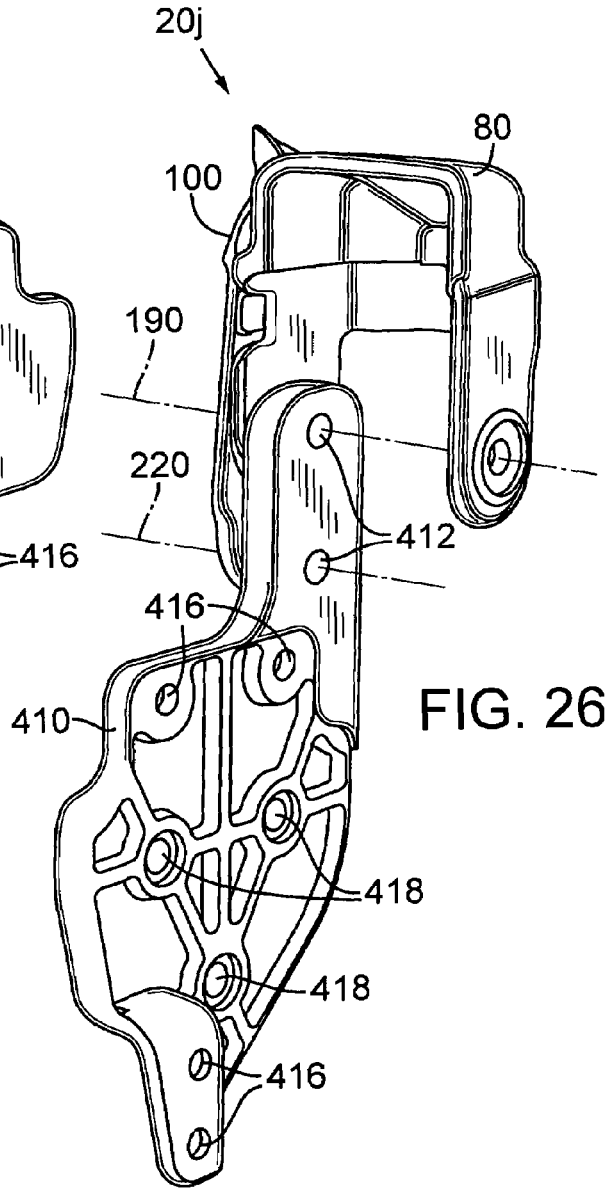
FIG. 26 is a rear perspective view of the security hood assembly and holster mounting platform of FIG. 25.

FIGS. 25 and 26 are respective front and rear perspective views of a security hood assembly 20*j* supported on a mounting platform 410, in accordance with still another embodiment. With reference to FIGS. 25 and 26, mounting platform 410 provides a common base for mounting hood 80, lever 100, and a holster body (omitted for clarity). Mounting platform 410 includes a first set of holes 412 (FIG. 26) for receiving pivot pins (not shown) for mounting hood 80 and lever 100 for rotation about their respective hood and lever pivot axes 190 and 220. A second set of holes 416 are provided for mounting the holster body to mounting platform 410, and a third set of holes 418 are provided for attaching mounting platform 410 to a belt loop 70 (FIG. 1) or other support structure. Mounting platform 410 facilitates modular construction and adjustable reconfigurable assembly of holsters to fit various handguns from various manufacturers. For example, subassembly 420 of the mounting platform 410 and security hood assembly 20*j* (including hood 80, lever 100, and the pivot pins), may be standard for a wide variety of handguns, while the body 30 may be selected to fit a particular model of handgun.

Figure 27:
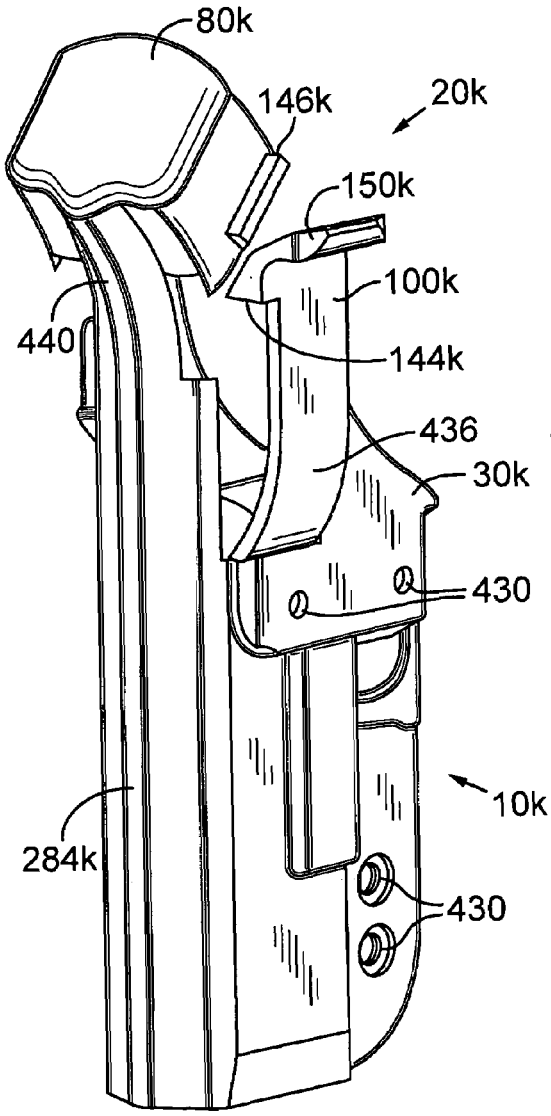
FIG. 27 is a front perspective view of a one-piece holster with security hood assembly, in accordance with yet another embodiment.
Figure 28:
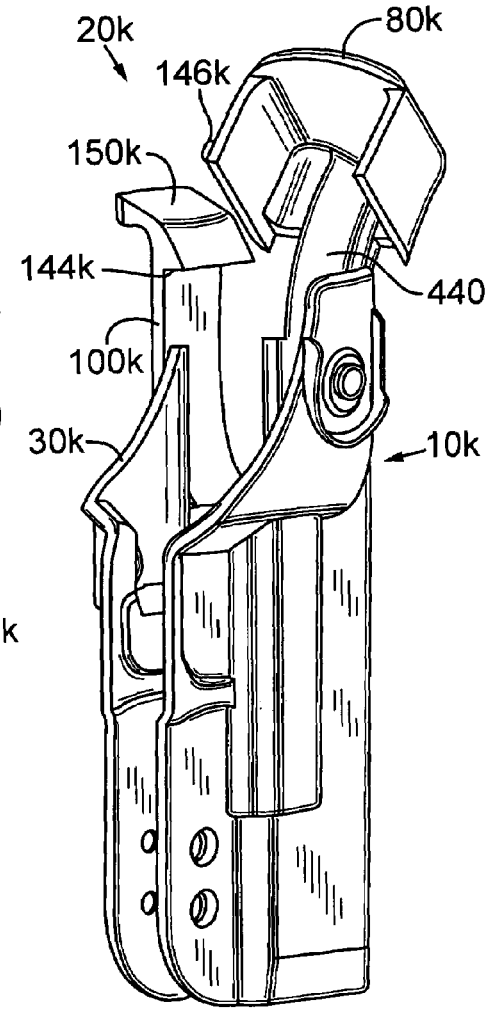
FIG. 28 is a rear perspective view of the holster of FIG. 27.

FIGS. 27 and 28 are respective front and rear perspective views of a one-piece holster assembly 10*k* with security hood assembly 20*k*, in accordance with yet another embodiment. With reference to FIGS. 27 and 28, holster 10*k* includes all necessary components of security hood assembly 20*k* integrally formed of unitary construction with body 30*k*. Body 30*k*, lever 100*k*, and hood 80*k* are preferably molded of a plastic resin in a single molding step. Thereafter, body 30*k* may be fitted with an internal retention device and tension adjustment insert (not shown). Body 30*k* includes mounting holes 430 (FIG. 27) for mounting holster 10*k* to a mounting platform or belt loop (not shown). Lever 100*k* includes a first latch part 144*k* in the shape of a catch or pawl along the side of lever 100*k* proximal hood 80*k* and an integral spring section 436. Hood 80*k* is attached to body 30*k* via a resilient neck portion 440, shown in FIGS. 27 and 28 in its neutral open position. Neck portion 440 extends upwardly from spine 284*k* of body 30*k* and is molded in a curved shape to provide spring force, discussed below. Hood 80*k* further includes a second latch part 146*k* along its inner side, adjacent lever 100*k*. When hood 80*k* is moved to the closed position (not shown) neck portion 440 flexes until first latch part 144*k* engages second latch part 146*k*. Latch parts 144*k* and 146*k* cooperate with the spring forces imparted by flexure of neck portion 440 and the reactive flexure of spring section 436, to thereby retain hood 80*k* in the closed position. Latch parts 144*k* and 146*k* may be undercut slightly so that the spring forces of spring section 436 and neck portion 440 drive latch parts 144*k* and 146*k* more tightly into engagement for a strong, but releasable lock. Thereafter, downward and inward pressure on thumb pad portion 150*k* of lever 100*k* will release the latch and allow the spring force of neck portion 440 to move hood 80*k* to the open position. Thus holster 10*k* includes an integral thumb-break security shroud that improves upon the conventional thumb-break safety strap by virtue of the security and safety features and other benefits described above with reference to this and other embodiments of the security hood assembly.

It will be obvious to those having skill in the art that many changes may be made to the details of the above-described embodiments without departing from the underlying principles of the invention. The scope of the present invention should, therefore, be determined only by the following claims.

The invention claimed is:

1. A holster for a service item comprising a cocked handgun including a hammer and a firing pin, the holster comprising:

a holster body defining a cavity and an opening sized to admit at least a portion of a service item into the cavity;

a hood supported for movement between a closed position wherein the hood extends over at least a portion of the opening to prevent the service item from being removed from the holster, and an open position wherein the hood is moved forwardly relative to the holster body to allow the service item to be removed from the holster; and a lever operably coupled to the hood for driving the hood from the closed position toward the open position in response to movement of the lever, the hood including a blocking section that is interposed between the hammer and the firing pin when the cocked handgun is holstered and the hood is in the closed position, to thereby prevent the hammer from accidentally falling against the firing pin.

2. A holster in accordance with claim 1 wherein the lever is geared to the hood.

3. A holster in accordance with claim 1 wherein the lever is coupled to the hood by a cam mechanism.

4. A holster in accordance with claim 1 wherein the hood is driven forwardly in response to movement of the lever in a direction other than forward.

5. A holster in accordance with claim 1 wherein the hood is driven forwardly in response to rearward movement of the lever.

6. A holster in accordance with claim 1 wherein the hood rotates about a hood pivot axis and the lever is supported on the holster body for rotation about a lever pivot axis that is substantially parallel to the hood pivot axis.

7. A holster in accordance with claim 1 further comprising a latch mechanism that releasably engages when the hood is in the closed position to inhibit the hood from being opened by an unauthorized person.

8. A holster in accordance with claim 7 wherein the latch mechanism is disengaged by manual operation of the lever.

9. A holster in accordance with claim 8 wherein at least a portion of the lever is moved in a first direction for disengaging the latch mechanism and in a second direction different from the first direction for driving the hood toward the open position.

10. A holster in accordance with claim 7 wherein: the lever includes a first part of the latch mechanism; the hood includes a second part of the latch mechanism; and the first and second parts of the latch mechanism are aligned for engagement when the hood is moved to the closed position.

11. A holster in accordance with claim 1 further comprising a stop for preventing the hood from moving rearwardly from the closed position.

12. A holster in accordance with claim 1 further comprising an internal retention device that extends into the cavity to releasably secure the service item in the holster.

13. A holster in accordance with claim 1 wherein the hood is formed of a substantially rigid material.

14. A holster in accordance with claim 1 further comprising an electronic device responsive to movement of the hood.

15. A security hood assembly for a holster having a holster body that defines a cavity and an opening sized to admit at least a portion of a service item into the cavity, comprising:

a hood adapted to be movably supported in association with the holster body so that the hood extends over at least a portion of the opening when the hood is in a closed position;

a lever coupled to the hood for driving the hood, the hood being responsive to operation of the lever for movement from the closed position wherein the hood prevents the service item from being removed from the holster toward an open position wherein the hood is moved forwardly relative to the holster body, to thereby allow the service item to be removed from the holster; and a latch mechanism operable to releasably engage when the hood is in the closed position to prevent the hood from being opened, the latch mechanism operable to be disengaged by manual operation of the lever, wherein at least a portion of the lever is moved in a first direction for disengaging the latch mechanism and in a second direction different from the first direction for driving the hood toward the open position.

16. A security hood assembly in accordance with claim 15 wherein the lever is geared to the hood.

17. A security hood assembly in accordance with claim 15 wherein the lever is coupled to the hood by a cam mechanism.

18. A security hood assembly in accordance with claim 15 wherein the hood is driven forwardly in response to movement of the lever in a direction other than forward.

19. A security hood assembly in accordance with claim 15 wherein the hood is driven forwardly in response to rearward movement of the lever.

20. A security hood assembly in accordance with claim 15 wherein: the hood is rotatable about a hood pivot axis when supported on the holster body; and the lever is adapted to be rotatably supported on the holster body for rotation about a lever pivot axis that is substantially parallel to the hood pivot axis.

21. A security hood assembly in accordance with claim 15 further comprising a stop for preventing the hood from moving rearwardly from the closed position.

22. A security hood assembly in accordance with claim 15 wherein: the service item comprises a cocked handgun including a hammer and a firing pin; and the hood includes a blocking section that is interposed between the hammer and the firing pin when the cocked handgun is holstered and the hood is in the closed position, to thereby prevent the hammer from accidentally falling against the firing pin.

23. A security hood assembly in accordance with claim 15 wherein the hood is formed of a substantially rigid material.

24. A security hood assembly in accordance with claim 15 further comprising an electronic device responsive to movement of the hood.

25. A holster for a service item comprising a cocked handgun including a hammer, the holster comprising:

a body means for holding the service item and for defining a constrained draw path of the service item;

a hood supported in association with the body means, the hood movable between a closed position wherein the hood extends over at least a portion of the constrained draw path to prevent the service item from being removed from the holster, and an open position wherein the hood is moved out of the constrained draw path to allow the service item to be removed from the holster;

a lever movably supported on the body means and adjacent the hood;

means for coupling the lever to the hood and for driving the hood from the closed position toward the open position in response to movement of the lever; and means for preventing the hammer of the cocked handgun from accidentally falling.

26. A holster in accordance with claim 25 further comprising means for releasably retaining the service item in the holster when the hood is in the open position.

27. A holster in accordance with claim 25 further comprising means for releasably locking the hood in the closed position.

28. A holster in accordance with claim 27 wherein: the means for releasably locking is unlocked by moving at least a portion of the lever in a first direction relative to the body means; and the hood is driven toward the open position in response to moving the lever in a second direction different from the first direction.

29. A security hood assembly for a holster having a holster body adapted to hold a service item and defining a draw path along which the service item must move when drawn from the holster, comprising:

a hood adapted to be movably supported in association with the holster body so that the hood extends over at least a portion of the draw path when the hood is in a closed position;

a lever adapted to be operably coupled to the hood for driving the hood, the hood being responsive to operation of the lever for movement from the closed position wherein the hood prevents the service item from being removed from the holster toward an open position wherein the hood is moved out of the draw path to allow the service item to be removed from the holster; and a latch mechanism operable to releasably engage when the hood is in the closed position to prevent the hood from being opened, wherein at least a portion of the lever is moved in a first direction for disengaging the latch mechanism and in a second direction different from the first direction for driving the hood toward the open position.

30. A security hood assembly in accordance with claim 29 wherein the lever is coupled to the hood by a cam mechanisim

31. A security hood assembly in accordance with claim 29 wherein the hood is driven forwardly in response to movement of the lever in a direction other than forward.

32. A security hood assembly in accordance with claim 29 wherein the hood is driven forwardly in response to rearward movement of the lever.

33. A security hood assembly in accordance with claim 29 wherein the hood includes a blocking section that is interposed between a hammer and a firing pin of a holstered cocked handgun when the hood is in the closed position, to thereby prevent the hammer from accidentally falling against the firing pin.

34. A security hood assembly in accordance with claim 29 wherein the hood is formed of a substantially rigid material.

35. In a holster of the type including a holster body for holding a service item and for defining a constrained draw path of the service item, the improvement comprising:

a hood formed of a substantially rigid material and supported in association with the holster body for movement between a closed position wherein the hood extends over at least a portion of the constrained draw path to prevent the service item from being removed from the holster, and an open position wherein the hood is moved out of the constrained draw path to allow the service item to be removed from the holster; and a lever operably coupled to the hood for driving the hood from the closed position toward the open position in response to movement of the lever, wherein the lever is coupled to the hood by a cam mechanism.

36. A holster in accordance with claim 35 wherein the hood is formed of a molded resin.

37. A holster in accordance with claim 35 wherein the hood includes a spanning portion that extends over the holstered service item when the hood is in the closed position and a front skirt depending downwardly from the spanning portion.

38. A holster in accordance with claim 35 wherein the service item includes a cocked handgun and the hood includes a blocking section that is interposed between a hammer and a firing pin of the cocked handgun when the cocked handgun is holstered and the hood is in the closed position, to thereby prevent the hammer from accidentally falling against the firing pin.

39. A holster in accordance with claim 35 wherein the hood is rotatably supported on the holster body.

40. A holster in accordance with claim 35 further comprising a stop for preventing the hood from moving rearwardly from the closed position.

41. A holster in accordance with claim 35 further comprising an internal retention device.

42. A holster in accordance with claim 35 further comprising an electronic device responsive to movement of the hood.

43. A security hood assembly for a holster having a holster body adapted to hold a service item and defining a draw path along which the service item must move when drawn from the holster, the service item comprising a cocked handgun including a hammer and a firing pin, the holster comprising:

a hood formed of a substantially rigid material and adapted to be supported in association with the holster body for movement between a closed position wherein the hood extends over at least a portion of the constrained draw path to prevent the service item from being removed from the holster, and an open position wherein the hood is moved out of the constrained draw path to allow the service item to be removed from the holster; and a lever operably coupled to the hood for driving the hood from the closed position toward the open position in response to movement of the lever, the hood including a blocking section that is interposed between the hammer and the firing pin when the cocked handgun is holstered and the hood is in the closed position, to thereby prevent the hammer from accidentally falling against the firing pin.

44. A security hood assembly in accordance with claim 43 wherein the hood is formed of a molded resin.

45. A security hood assembly in accordance with claim 43 wherein the hood includes a spanning portion that extends over the holstered service item when the hood is in the closed position and a front skirt depending downwardly from the spanning portion.

46. A security hood assembly in accordance with claim 43 wherein the hood is adapted to be rotatably supported on the holster body.

47. A security hood assembly in accordance with claim 43 wherein the lever is coupled to the hood by a cam mechanism.

48. A security hood assembly in accordance with claim 43 further comprising a stop for preventing the hood from moving rearwardly from the closed position.

49. A security hood assembly in accordance with claim 43 further comprising an electronic device responsive to movement of the hood.

* * * * *